US007735994B2

(12) United States Patent
Silverbrook

(10) Patent No.: US 7,735,994 B2
(45) Date of Patent: Jun. 15, 2010

(54) WALL MOUNTABLE PRINTER WITH REMOVABLE CARTRIDGE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 226 days.

(21) Appl. No.: 11/014,730

(22) Filed: Dec. 20, 2004

(65) Prior Publication Data

US 2006/0132560 A1 Jun. 22, 2006

(51) Int. Cl.
*B41J 29/13* (2006.01)

(52) U.S. Cl. ..... 347/108

(58) Field of Classification Search ..... 347/5, 347/40, 42, 86, 87, 108; 396/30
See application file for complete search history.

(56) References Cited

U.S. PATENT DOCUMENTS 3,868,698 A * 2/1975 Dressler ..... 347/75
5,542,487 A * 8/1996 Schultz et al. ..... 178/4.1 A
5,682,191 A * 10/1997 Barrett et al. ..... 347/104
6,069,642 A * 5/2000 Isobe ..... 347/176
6,149,256 A * 11/2000 McIntyre et al. ..... 347/2
6,312,114 B1 * 11/2001 Silverbrook ..... 347/85
6,577,818 B2 * 6/2003 Hirano ..... 396/30
6,824,129 B2 * 11/2004 Sides, II ..... 271/3.14
7,014,286 B2 * 3/2006 Yonekubo ..... 347/7

FOREIGN PATENT DOCUMENTS

JP 2001096847 * 4/2001
JP 2002-060117 A 2/2002
JP 2002060117 * 2/2002
JP 2002234663 A * 8/2002
JP 2003-001902 A 1/2003
KR 2000-041224 7/2000

* cited by examiner

*Primary Examiner*—Anh T. N. Vo

(57) ABSTRACT

A printer unit is provided comprising a print engine incorporating a removable pagewidth printhead for printing on print media and a body arranged to house the print engine and to be mountable to a substantially vertical surface so as to suspend the printer unit. Such a wall mountable printer is capable of blending into the design of a home or a work space within office environment whilst providing high-speed, e.g., more than 30 pages per minute, and high-quality, e.g., images of about 1200 dots per inch or more, printing capabilities and ease of use.

15 Claims, 32 Drawing Sheets

WALL MOUNTABLE PRINTER WITH REMOVABLE CARTRIDGE

FIELD OF THE INVENTION

The present invention relates to a wall-mountable, high-speed printer, and more particularly to a printer which can print more than 30 pages or more a minute at high quality whilst being capable of blending into the design of a home or office environment.

CO-PENDING APPLICATIONS

The following applications have been filed by the Applicant simultaneously with the present application:

| | | | | |
|---|---|---|---|---|
| 7,152,972 | 11/014,731 | 11/014,764 | 11/014,763 | 11/014,748 |
| 11/014,747 | 11/014,761 | 11/014,760 | 11/014,757 | 11/014,714 |
| 11/014,713 | 11/014,762 | 11/014,724 | 11/014,723 | 11/014,756 |
| 11/014,736 | 11/014,759 | 11/014,758 | 11/014,725 | 11/014,739 |
| 11/014,738 | 11/014,737 | 11/014,726 | 11/014,745 | 11/014,712 |
| 11/014,715 | 11/014,751 | 11/014,735 | 11/014,734 | 11/014,719 |
| 11/014,750 | 11/014,749 | 11/014,746 | 11/014,769 | 11/014,729 |
| 11/014,743 | 11/014,733 | 11/014,754 | 11/014,755 | 11/014,765 |
| 11/014,766 | 11/014,740 | 11/014,720 | 11/014,753 | 11/014,752 |
| 11/014,744 | 11/014,741 | 11/014,768 | 11/014,767 | 11/014,718 |
| 11/014,717 | 11/014,716 | 11/014,732 | 11/014,742 | 11/014,722 |
| 11/014,728 | 11/014,727 | | | |

The disclosures of these co-pending applications are incorporated herein by reference.

CROSS REFERENCES TO RELATED APPLICATIONS

The following patents or patent applications filed by the applicant or assignee of the present invention are hereby incorporated by cross-reference.

| | | | | |
|---|---|---|---|---|
| 11/003,786 | 11/003,616 | 11/003,418 | 11/003,334 | 11/003,600 |
| 11/003,404 | 11/003,419 | 11/003,700 | 11/003,601 | 11/003,618 |
| 11/003,615 | 11/003,337 | 11/003,698 | 11/003,420 | 6,984,017 |
| 11/003,699 | 11/003,463 | 11/003,701 | 11/003,683 | 11/003,614 |
| 11/003,702 | 11/003,684 | 11/003,619 | 11/003,617 | 6,623,101 |
| 6,406,129 | 6,505,916 | 6,457,809 | 6,550,895 | 6,457,812 |
| 7,152,962 | 6,428,133 | 10/815,625 | 10/815,624 | 10/815,628 |
| 10/913,375 | 10/913,373 | 10/913,374 | 10/913,372 | 7,138,391 |
| 7,153,956 | 10/913,380 | 10/913,379 | 10/913,376 | 7,122,076 |
| 7,148,345 | 10/407,212 | 10/407,207 | 10/683,064 | 10/683,041 |
| 10/882,774 | 10/884,889 | 10/922,890 | 10/922,875 | 10/922,885 |
| 10/922,889 | 10/922,884 | 10/922,879 | 10/922,887 | 10/922,888 |
| 10/922,874 | 10/922,873 | 10/922,871 | 10/922,880 | 10/922,881 |
| 10/922,882 | 10/922,883 | 10/922,878 | 10/922,872 | 10/922,876 |
| 10/922,886 | 10/922,877 | 6,746,105 | 7,156,508 | 7,159,972 |
| 7,083,271 | 7,165,834 | 7,080,894 | 10/760,218 | 7,090,336 |
| 7,156,489 | 10/760,233 | 10/760,246 | 7,083,257 | 10/760,243 |
| 10/760,201 | 10/760,185 | 10/760,253 | 10/760,255 | 10/760,209 |
| 7,118,192 | 10/760,194 | 10/760,238 | 7,077,505 | 10/760,235 |
| 7,077,504 | 10/760,189 | 10/760,262 | 10/760,232 | 10/760,231 |
| 7,152,959 | 10/760,190 | 7,178,901 | 10/760,227 | 7,108,353 |
| 7,104,629 | 10/728,804 | 7,128,400 | 7,108,355 | 6,991,322 |
| 10/728,790 | 7,118,197 | 10/728,970 | 10/728,784 | 10/728,783 |
| 7,077,493 | 6,962,402 | 10/728,803 | 7,147,308 | 10/728,779 |
| 7,118,198 | 7,168,790 | 7,172,270 | 10/773,199 | 6,830,318 |
| 10/773,201 | 7,175,261 | 10/773,183 | 7,108,356 | 7,118,202 |
| 10/773,186 | 7,134,744 | 10/773,185 | 7,134,743 | 7,182,439 |
| 10/773,203 | 10/773,187 | 7,134,745 | 7,156,484 | 7,118,201 |
| 7,111,926 | 10/773,184 | 09/575,197 | 7,079,712 | 09/575,123 |
| 6,825,945 | 09/575,165 | 6,813,039 | 6,987,506 | 7,038,797 |
| 6,980,318 | 6,816,274 | 7,102,772 | 09/575,186 | 6,681,045 |
| 6,728,000 | 7,173,722 | 7,088,459 | 09/575,181 | 7,068,382 |

-continued

| | | | | |
|---|---|---|---|---|
| 7,062,651 | 6,789,194 | 6,789,191 | 6,644,642 | 6,502,614 |
| 6,622,999 | 6,669,385 | 6,549,935 | 6,987,573 | 6,727,996 |
| 6,591,884 | 6,439,706 | 6,760,119 | 09/575,198 | 7,064,851 |
| 6,826,547 | 6,290,349 | 6,428,155 | 6,785,016 | 6,831,682 |
| 6,741,871 | 6,927,871 | 6,980,306 | 6,965,439 | 6,840,606 |
| 7,036,918 | 6,977,746 | 6,970,264 | 7,068,389 | 7,093,991 |
| 10/659,026 | 10/884,885 | 10/884,883 | 10/901,154 | 10/932,044 |
| 10/962,412 | 7,177,054 | 10/962,552 | 10/965,733 | 10/965,933 |
| 10/974,742 | 10/986,375 | 6,982,798 | 6,870,966 | 6,822,639 |
| 6,737,591 | 7,055,739 | 09/575,129 | 6,830,196 | 6,832,717 |
| 6,957,768 | 7,170,499 | 7,106,888 | 7,123,239 | 10/727,181 |
| 10/727,162 | 10/727,163 | 10/727,245 | 7,121,639 | 7,165,824 |
| 7,152,942 | 10/727,157 | 7,181,572 | 7,096,137 | 10/727,257 |
| 10/727,238 | 7,188,282 | 10/727,159 | 10/727,180 | 10/727,179 |
| 10/727,192 | 10/727,274 | 10/727,164 | 10/727,161 | 10/727,198 |
| 10/727,158 | 10/754,536 | 10/754,938 | 10/727,227 | 10/727,160 |
| 10/934,720 | 10/296,522 | 6,795,215 | 7,070,098 | 7,154,638 |
| 6,805,419 | 6,859,289 | 6,977,751 | 6,398,332 | 6,394,573 |
| 6,622,923 | 6,747,760 | 6,921,144 | 10/884,881 | 7,092,112 |
| 10/949,294 | 10/854,521 | 10/854,522 | 10/854,488 | 10/854,487 |
| 10/854,503 | 10/854,504 | 10/854,509 | 10/854,510 | 7,093,989 |
| 10/854,497 | 10/854,495 | 10/854,498 | 10/854,511 | 10/854,512 |
| 10/854,525 | 10/854,526 | 10/854,516 | 10/854,508 | 10/854,507 |
| 10/854,515 | 10/854,506 | 10/854,505 | 10/854,493 | 10/854,494 |
| 10/854,489 | 10/854,490 | 10/854,492 | 10/854,491 | 10/854,528 |
| 10/854,523 | 10/854,527 | 10/854,524 | 10/854,520 | 10/854,514 |
| 10/854,519 | 10/854,513 | 10/854,499 | 10/854,501 | 10/854,500 |
| 10/854,502 | 10/854,518 | 10/854,517 | 10/934,628 | |

BACKGROUND OF THE INVENTION

With recent trends of incorporating electronic equipment into the decoŕe of the home and office and the provision of smaller and more compact workstations in office environments, it has become necessary to design such equipment to suit such decoŕe whilst maximising available workspace. With respect to reducing the amount of space occupied by traditional office equipment such as printers, wall mountable printers have been proposed. Whilst such proposals have been successful in freeing up the amount of available space by removing the printer from the desktop, this has typically resulted in printer units having reduced printing capabilities, poor aesthetic appeal and increased complexity for users.

Thus, there is a need to provide a wall mountable printer suitable for use in both home and office environments which is capable of blending into the design of the home or work space whilst providing high-speed, e.g., more than 30 pages per minute (ppm), and high-quality, e.g., images of about 1200 dots per inch (dpi) or more, printing capabilities and ease of use.

SUMMARY OF THE INVENTION

In a first aspect the present invention provides a printer unit comprising:

a print engine for printing on print media; and a body housing said print engine and adapted to be mounted to a substantially vertical surface in a suspended arrangement, wherein the print engine incorporates a removable page-width printhead for printing on said print media.

Optionally the print engine comprises a cradle unit removably mounted to the body and a cartridge unit which incorporates the printhead and is removably received within the cradle unit.

Optionally the cartridge unit further incorporates at least one ink handling and storage reservoir from which the printhead draws ink for printing in said print media.

Optionally the cradle unit incorporates drive electronics for controlling the printing performed by the printhead.

Optionally the body has a rear surface arranged to be mountable to said substantially vertical surface and an inner section arranged to house the print engine.

Optionally the rear surface of the body is arranged with mounting bosses for mounting the printer unit to said substantially vertical surface.

Optionally the rear surface of the body is arranged with a hook for mounting the printer unit over a top surface of said substantially vertical surface.

Optionally said substantially vertical surface is a wall.

Optionally said substantially vertical surface is a privacy screen of an office workstation.

Optionally there is provided a printer unit, wherein:

the inner section of the body is further arranged to mount a print media supply for supplying print media to the pagewidth printhead; and the rear surface of the body is further arranged to mount an extendable print media collector for collecting print media printed on by the pagewidth printhead.

Optionally the body has a front surface which is adapted to receive an ornamentation.

Optionally the body is arranged to house a print media collector which is automatically extendable from the body upon commencement of printing to collect the printed media.

Optionally the pagewidth printhead is arranged as a two-dimensional array of at least 20000 printing nozzles for printing across the width of said print media.

Optionally the pagewidth printhead incorporates an array of ink ejecting nozzles arranged to print on said print media by ejecting drops of ink across the width of said print media at a rate of at least 50 million drops per second.

In a second aspect the present invention provides a printer unit comprising:

a print engine for printing on print media; and a body housing said print engine and adapted to be mounted to a substantially vertical surface in a suspended arrangement, wherein the body has a front surface which is adapted to receive an ornamentation.

Optionally said ornamentation is one or more selected from the group consisting of a picture, a photo, a print, a certificate and a painting.

Optionally the front surface has a transparent window and a picture frame arranged thereabouts for display of said ornamentation.

Optionally the picture frame has a size which is substantially the same as the size of the front surface of the body.

Optionally the picture frame is arranged to be removable from the front surface of the body.

Optionally the body further has a rear surface arranged to be mountable to said substantially vertical surface and an inner section arranged to house the print engine.

Optionally the rear surface of the body is arranged with mounting bosses for mounting the printer unit to said substantially vertical surface.

Optionally the rear surface of the body is arranged with a hook for mounting the printer unit over a top surface of said substantially vertical surface.

Optionally the print engine is removable from the inner section of the body.

In a further aspect there is provided a printer unit, wherein:

the inner section of the body is further arranged to mount a print media supply for supplying print media to the print engine; and the rear surface of the body is further arranged to mount an extendable print media collector for collecting print media printed on by the print engine.

Optionally said substantially vertical surface is a wall.

Optionally said substantially vertical surface is a privacy screen of an office workstation.

Optionally the print engine incorporates a removable pagewidth printhead for printing on said print media.

Optionally the body is arranged to house a print media collector which is automatically extendable from the body upon commencement of printing to collect the printed media.

Optionally the print engine incorporates a pagewidth printhead arranged as a two-dimensional array of at least 20000 printing nozzles for printing across the width of said print media.

Optionally the print engine incorporates an array of ink ejecting nozzles configured as a pagewidth printhead arranged to print on said print media by ejecting drops of ink across the width of said print media at a rate of at least 50 million drops per second.

In a third aspect the present invention provides a printer unit comprising:

a print engine for printing on print media; and a body housing said print engine and adapted to be mounted to a substantially vertical surface in a suspended arrangement, wherein the body is further arranged to house a print media collector which is automatically extendable from the body upon commencement of printing to collect the printed media.

Optionally the body has a rear surface arranged to be mountable to said substantially vertical surface and an inner section arranged to house the print engine.

Optionally the print media collector is retractable into the inner section of the body so as not to substantially project from the body.

Optionally the inner section of the body is further arranged with a winding arrangement for bi-directionally winding a wire attached to a top surface of the print media collector so as to retract and extend the print media collector into and out from the body.

Optionally the winding arrangement comprises a winch about which the wire is wound and unwound and a motor for operating the winch so as to wind and unwind the wire.

Optionally the motor of the winding arrangement is controlled by drive electronics of the print engine, which control the printing performed by the print engine, so as to wind and unwind the wire in conjunction with the print engine printing on said print media.

Optionally the rear surface of the body is arranged with mounting bosses for mounting the printer unit to said substantially vertical surface.

Optionally the rear surface of the body is arranged with a hook for mounting the printer unit over a top surface of said substantially vertical surface.

Optionally said substantially vertical surface is a wall.

Optionally said substantially vertical surface is a privacy screen of an office workstation.

Optionally the print engine is removable from the inner section of the body.

Optionally the inner section of the body is further arranged to mount a print media supply for supplying print media to the print engine.

Optionally the print engine incorporates a removable pagewidth printhead for printing on said print media.

Optionally the body has a front surface which is adapted to receive an ornamentation.

Optionally the print engine incorporates a pagewidth printhead arranged as a two-dimensional array of at least 20000 printing nozzles for printing across the width of said print media.

Optionally the print engine incorporates an array of ink ejecting nozzles configured as a pagewidth printhead arranged to print on said print media by ejecting drops of ink across the width of said print media at a rate of at least 50 million drops per second.

In a fourth aspect the present invention provides a printer unit comprising:

a print engine for printing on print media; and a body housing said print engine and adapted to be mounted to a substantially vertical surface in a suspended arrangement, wherein the print engine incorporates a pagewidth printhead arranged as a two-dimensional array of at least 20000 printing nozzles for printing across the width of said print media.

Optionally the pagewidth printhead is arranged as a two-dimensional array of at least 30,000 printing nozzles for printing across the width of said print media.

Optionally the pagewidth printhead is arranged as a two-dimensional array of at least 40,000 printing nozzles for printing across the width of said print media.

Optionally the pagewidth printhead is arranged as a two-dimensional array of at least 50,000 printing nozzles for printing across the width of said print media.

Optionally the body has a rear surface arranged to be mountable to said substantially vertical surface and an inner section arranged to house the print engine.

Optionally the rear surface of the body is arranged with mounting bosses for mounting the printer unit to said substantially vertical surface.

Optionally the rear surface of the body is arranged with a hook for mounting the printer unit over a top surface of said substantially vertical surface.

Optionally the print engine is removable from the inner section of the body.

In a further aspect there is provided a printer unit, wherein:

the inner section of the body is further arranged to mount a print media supply for supplying print media to the pagewidth printhead; and the rear surface of the body is further arranged to mount an extendable print media collector for collecting print media printed on by the pagewidth printhead.

Optionally said substantially vertical surface is a wall.

Optionally said substantially vertical surface is a privacy screen of an office workstation.

Optionally the print engine incorporates a removable pagewidth printhead for printing on said print media.

Optionally the body has a front surface which is adapted to receive an ornamentation.

Optionally the body is arranged to house a print media collector which is automatically extendable from the body upon commencement of printing to collect the printed media.

Optionally the printing nozzles are arranged to print on said print media by ejecting drops of ink across the width of said print media at a rate of at least 50 million drops per second.

In a fifth aspect the present invention provides a printer unit comprising:

a print engine for printing on print media; and a body housing said print engine and adapted to be mounted to a substantially vertical surface in a suspended arrangement, wherein the print engine incorporates an array of ink ejecting nozzles configured as a pagewidth printhead arranged to print on said print media by ejecting drops of ink across the width of said print media at a rate of at least 50 million drops per second.

Optionally the array of ink ejecting nozzles are configured to eject drops of ink across the width of said print media at a rate of at least 100 million drops per second.

Optionally the array of ink ejecting nozzles are configured to eject drops of ink across the width of said print media at a rate of at least 300 million drops per second.

Optionally the array of ink ejecting nozzles are configured to eject drops of ink across the width of said print media at a rate of at least one billion drops per second.

Optionally the body has a rear surface arranged to be mountable to said substantially vertical surface and an inner section arranged to house the print engine.

Optionally the rear surface of the body is arranged with mounting bosses for mounting the printer unit to said substantially vertical surface.

Optionally the rear surface of the body is arranged with a hook for mounting the printer unit over a top surface of said substantially vertical surface.

Optionally the print engine is removable from the inner section of the body.

In a further aspect there is provided a printer unit, wherein:

the inner section of the body is further arranged to mount a print media supply for supplying print media to the pagewidth printhead; and the rear surface of the body is further arranged to mount an extendable print media collector for collecting print media printed on by the pagewidth printhead.

Optionally said substantially vertical surface is a wall.

Optionally said substantially vertical surface is a privacy screen of an office workstation.

Optionally the print engine incorporates a removable pagewidth printhead for printing on said print media.

Optionally the body has a front surface which is adapted to receive an ornamentation.

Optionally the body is arranged to house a print media collector which is automatically extendable from the body upon commencement of printing to collect the printed media.

Optionally the array of ink ejecting nozzles is arranged as a two-dimensional array of at least 20000 ink ejecting nozzles for printing across the width of said print media.

DETAILED DESCRIPTION OF THE EMBODIMENTS

Figure 1:
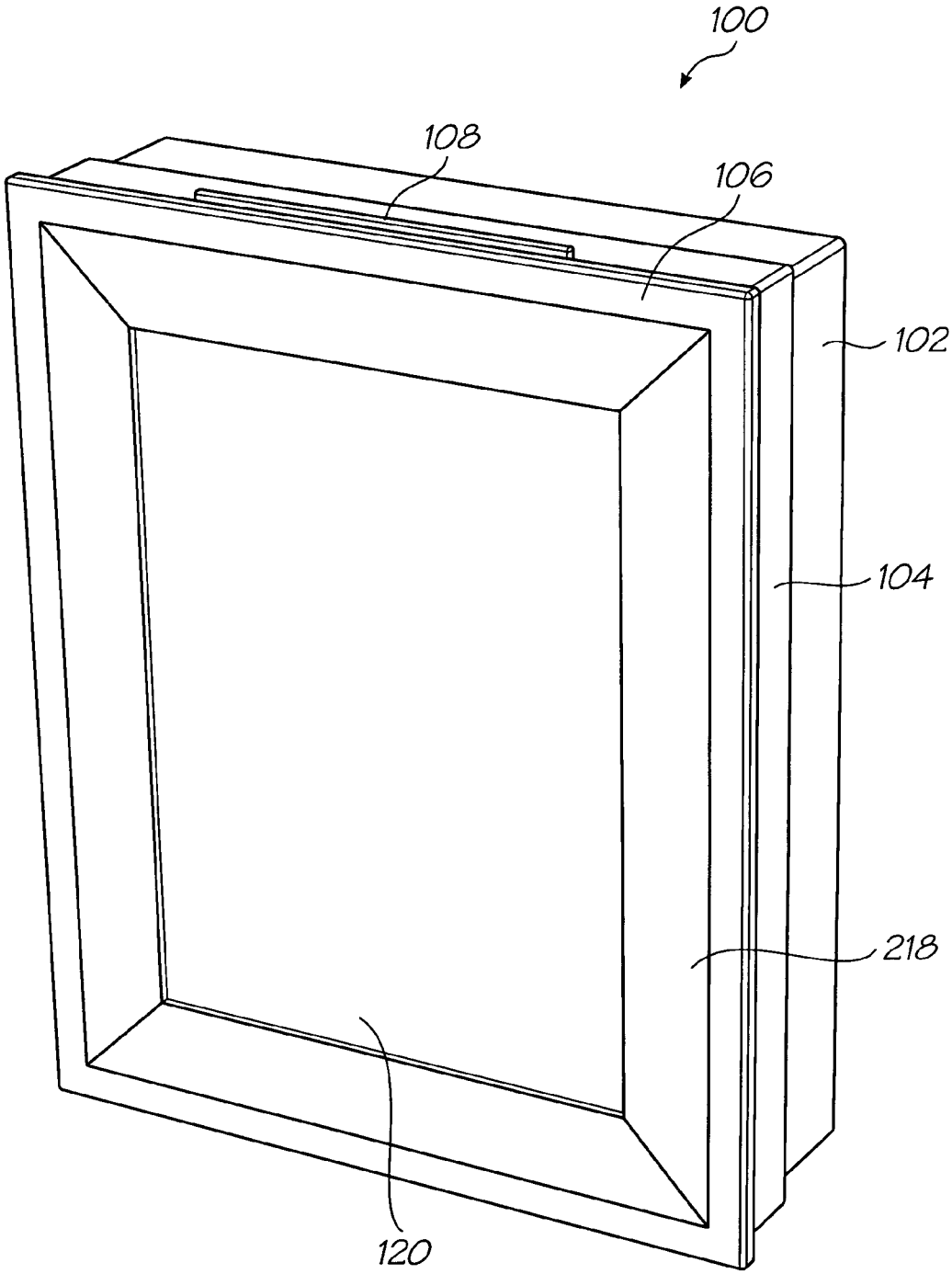
FIG. 1 shows a perspective view of a printer in accordance with an embodiment of the present invention.
Figure 2:
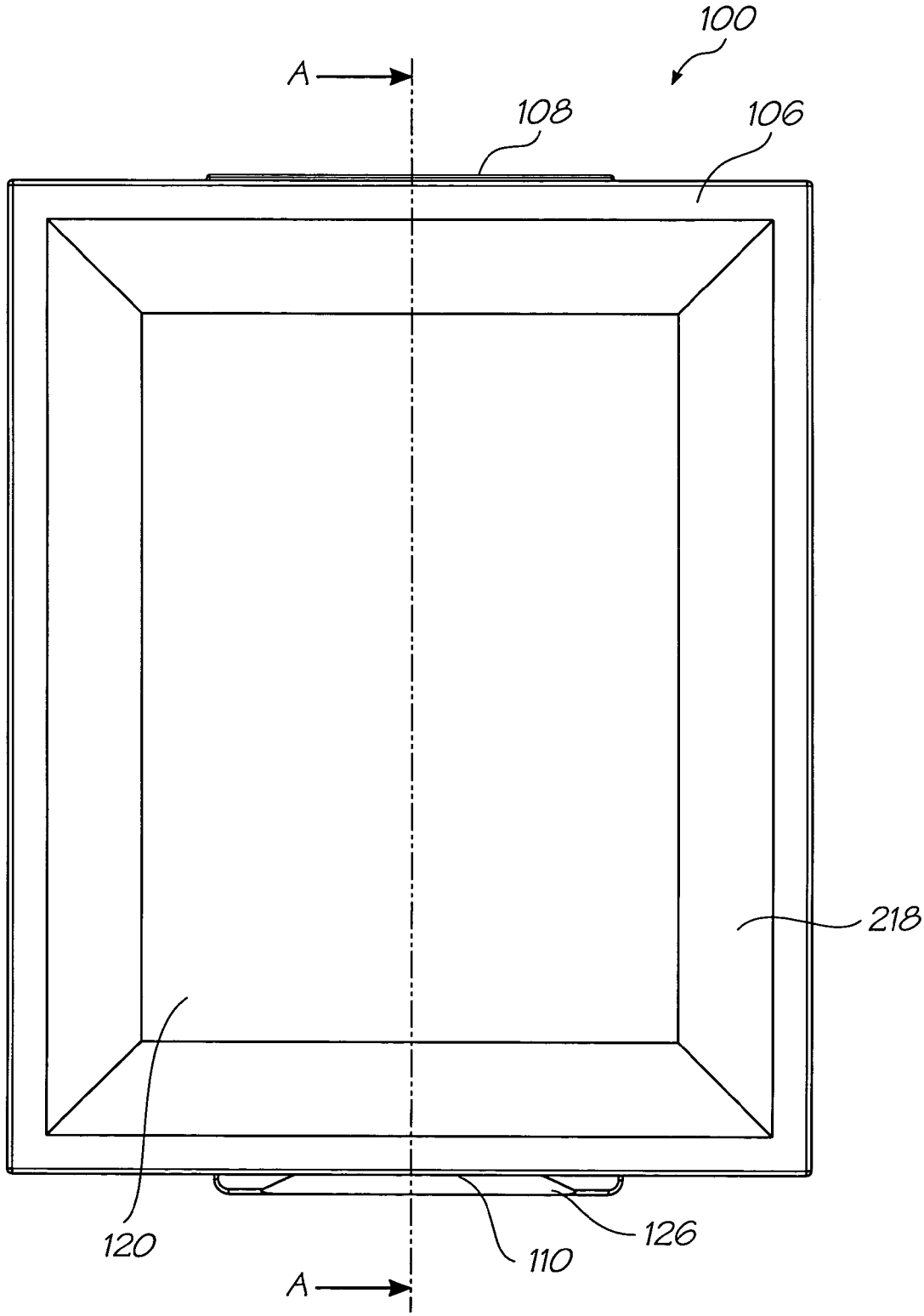
FIG. 2 shows a front plan view of the printer of FIG. 1.

A frontal view of a printer 100 in accordance with an embodiment of the present invention is illustrated in FIGS. 1 and 2. The printer 100 comprises a body 102, a print media source tray assembly 104 hingedly attached to the body 102 for storing print media to be printed on by the printer 100, a facia 106 hingedly attached to the outer, front surface of the source tray assembly 104, a handle 108 provided on an upper, outer surface of the source tray assembly 104 for assisting the hinged operation of the source tray assembly 104 from the body 102, and a print media collector 110 which can be extended from the bottom surface of the body 102 for collecting printed media. In combination, the source tray assembly 104, the facia 106 and the collector 110 may form part of the body 102 of the printer 100.

Figure 3:
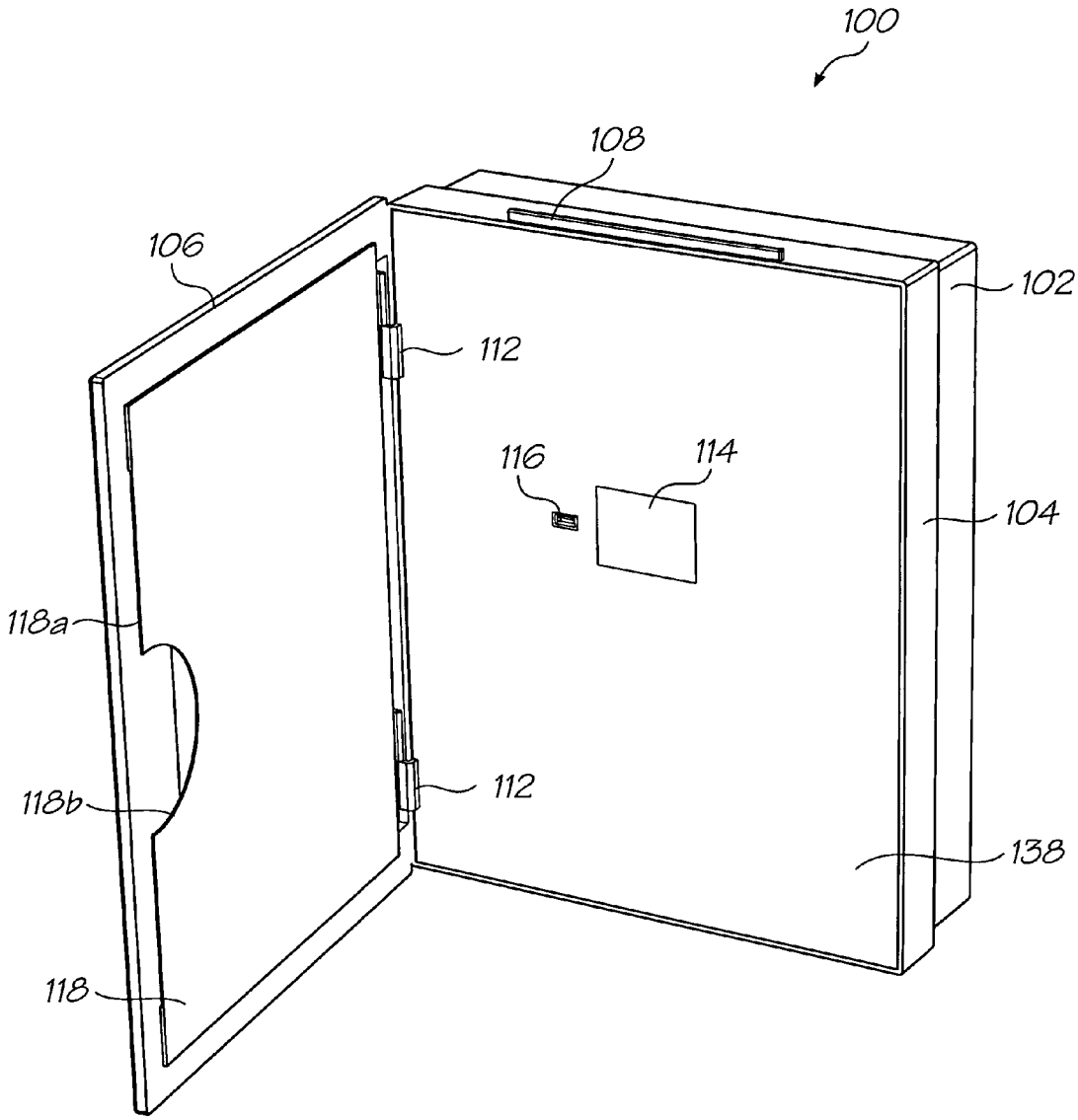
FIG. 3 illustrates an open position of a facia of the printer of FIG. 1.

As shown in FIG. 3, the facia 106 is hingedly attached to the source tray assembly 104 with hinges 112, which are inset within the rear surface of the facia 106 so as to provide a flush fitting of the facia 104 to the outer surface of the source tray assembly 104. The facia 106 is hingedly attached to the source tray assembly 104 so as to provide access to a user interface 114 and a data connector 116 of the printer 100, or any other components which may be provided on the outer surface of the source tray assembly 104. Access is also provided in this way to the inner surface of the facia 106 which has an envelope portion 118 provided thereon. The envelope portion 118 is provided for the housing of pictures, photos, prints, certificates, paintings and like ornamentations in the front of the printer 100 for display through a transparent portion or window 120 provided on the outer surface of the facia 106 (see FIG. 1). This aspect of the printer 100 will be described in more detail later.

Figure 4:
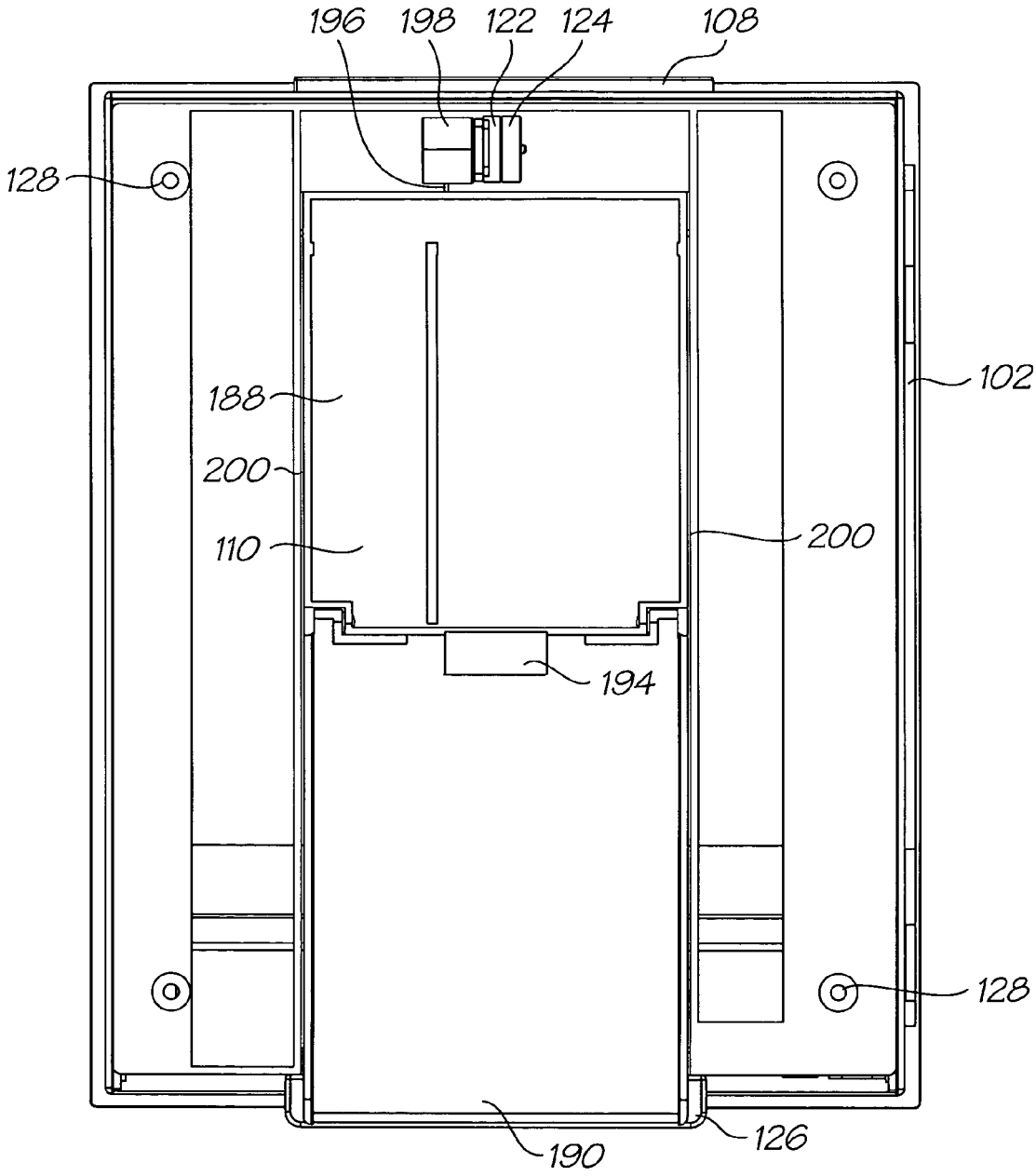
FIG. 4 shows a rear view of the printer of FIG. 1.
Figure 5:
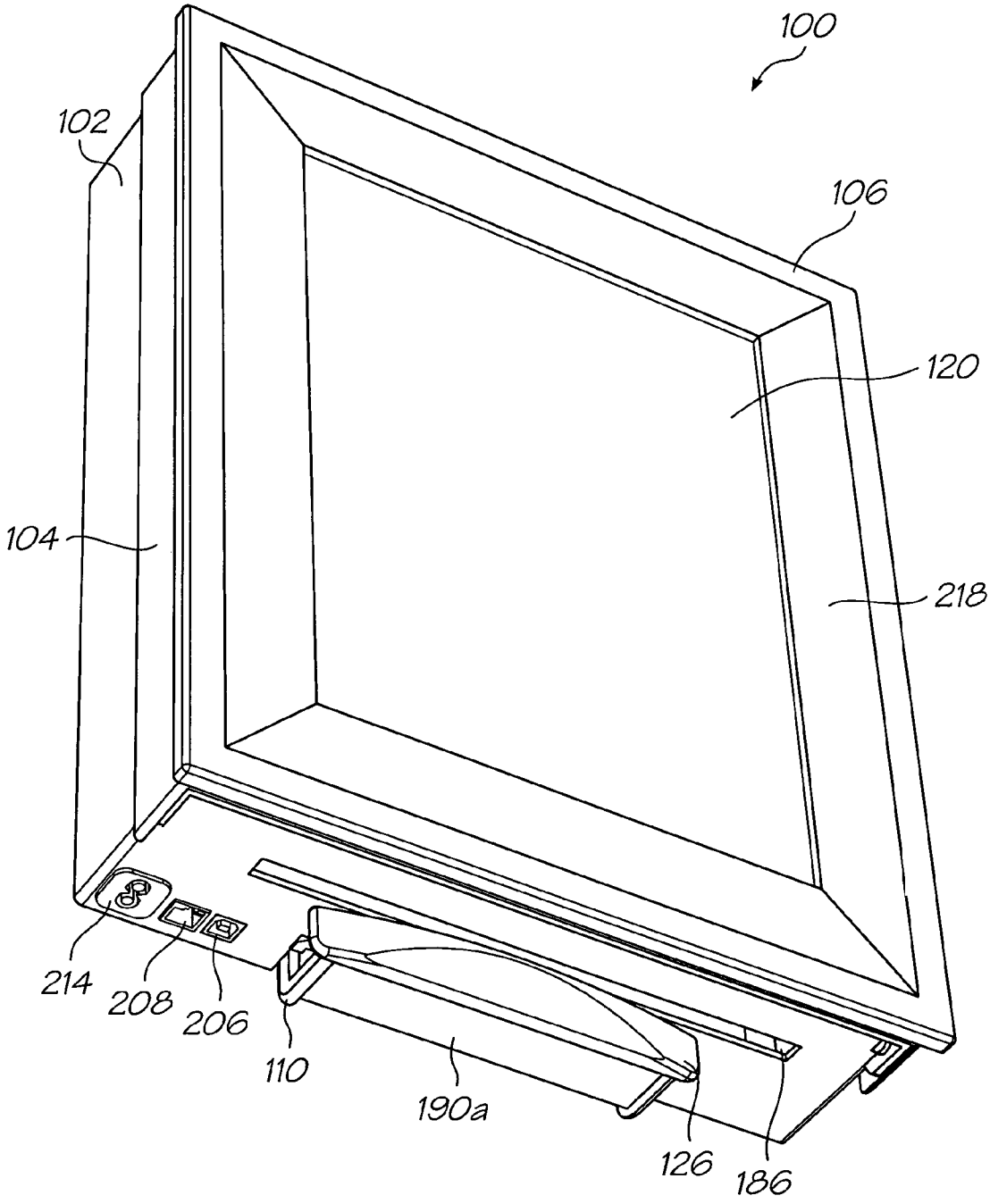
FIG. 5 shows an underside perspective view of the printer of FIG. 1.

Referring to FIG. 4, the print media collector 110 is housed within a rear surface of the body 102, as is a winding arrangement 122 and associated motor 124 provided to drive the extension (and retraction) of the collector 110 out from (and into) the bottom surface of the body 102. As shown in FIG. 5, whilst the collector 110 is substantially housed in the body 102 in its retracted position, a retaining portion 126 of the collector 110 is provided outside of the bottom surface of the body 102. Even so, when not being used to collect printed media, the collector 110 is housed within the body 102 so as to be barely noticeable from the front of the mounted printer 100 since the collector 110 is substantially hidden by the body 102 itself with the collector 110 on the rear surface of the body 102 which faces a wall or other substantially vertical surface to which the printer 100 is mounted. In order to mount the printer 100 to a wall, etc mounting bosses 128 may be provided (see FIG. 4), which will be described in more detail later.

Figure 6:
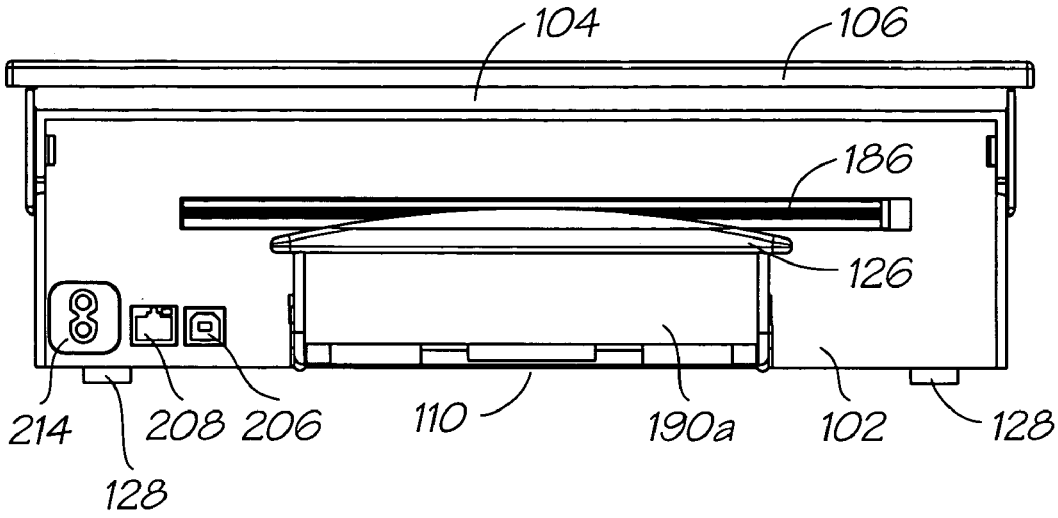
FIG. 6 shows a bottom view of the printer of FIG. 1.
Figure 7:
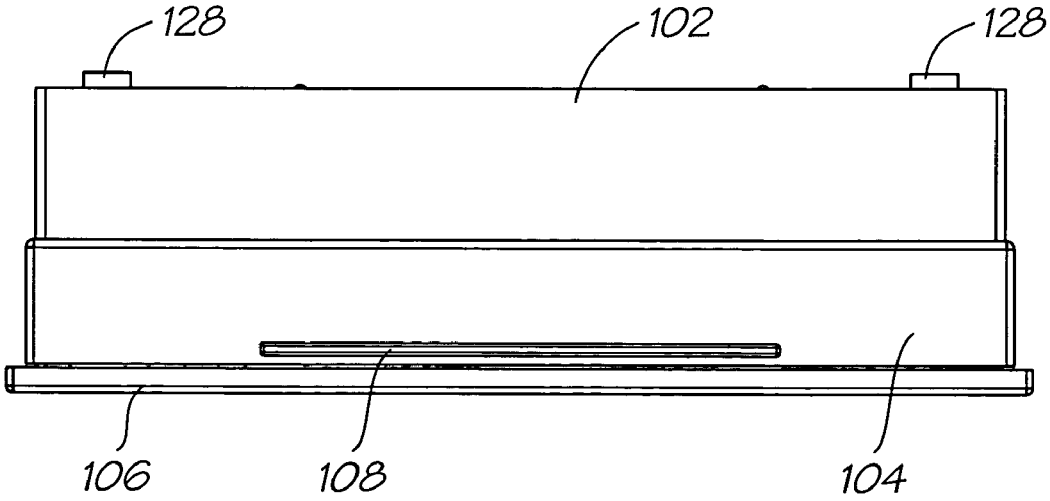
FIG. 7 shows a top view of the printer of FIG. 1.
Figure 8:
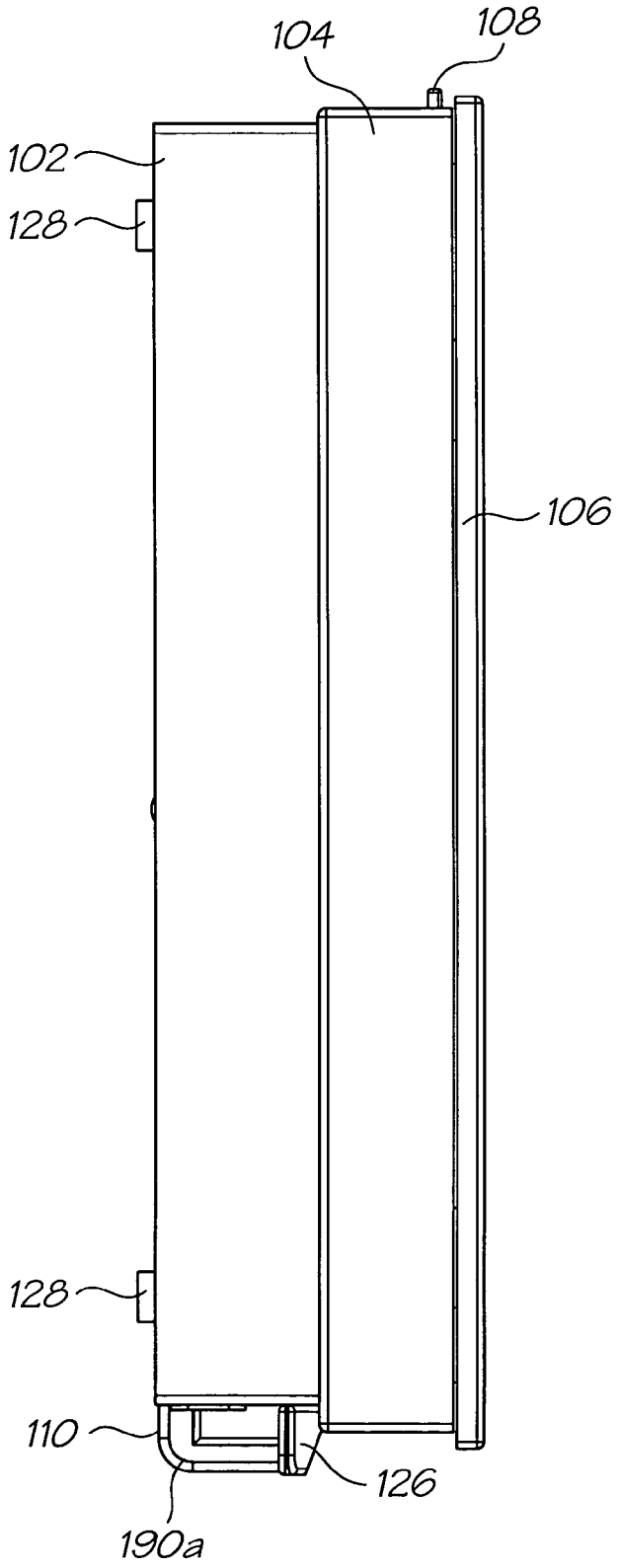
FIG. 8 shows a side view of the printer of FIG. 1.

As can be seen from the bottom, top and side views of FIGS. 6, 7 and 8, respectively, the printer 100 comprising of the above-mentioned components is relatively compact. As such, when mounted to a wall, etc the printer 100 projects a minimal distance therefrom, which minimises the amount of space occupied by the printer 100. This compactness is further facilitated by the retractable/extendable collector 110 which is extended from the printer 100 when printing is being performed and is retracted within the body 102 when not in use. Further, by providing the facia 106 which is able to receive prints, etc on the front surface of the tray assembly 106, the actual printer 100 itself can be substantially hidden or disguised from view when not printing, as will be apparent to those skilled in the art from the following description.

Figure 9:
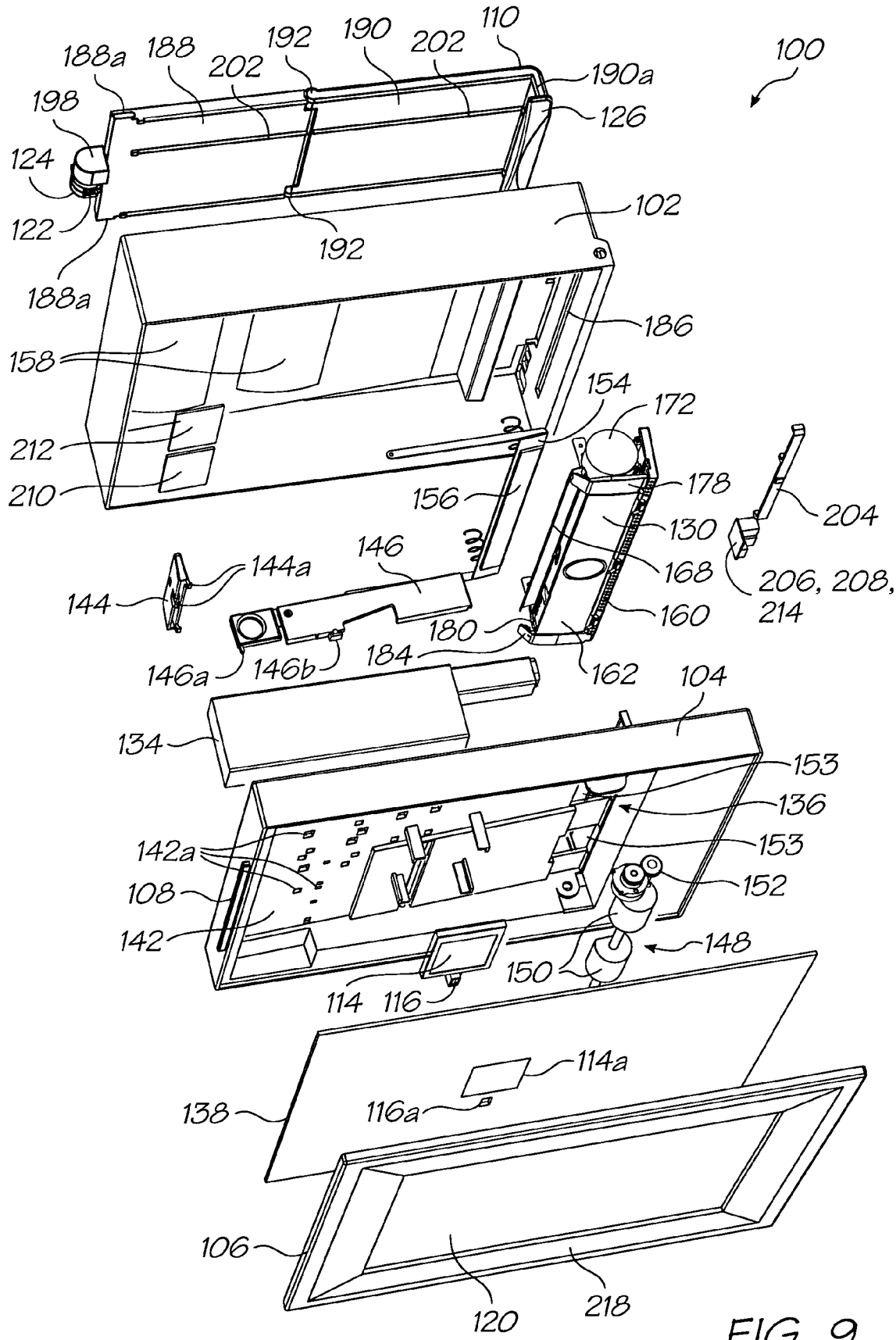
FIG. 9 shows an exploded view of the printer of FIG. 1 illustrating the various components thereof.

An exploded view of the printer 100 is provided in FIG. 9 illustrating the various components thereof. As can be seen, the printer 100 is basically constructed as an assembly of the body 102, the source tray assembly 104, the facia 106 and the collector 110 with their associated components, such as a print engine assembly 130 for printing on print media 132 sourced from the source tray assembly 104 and a power supply unit (PSU) 134 for powering the print engine assembly 130 and other electronics of the printer 100, which are both housed within the body 102, as further shown in FIG. 10.

Figure 10:
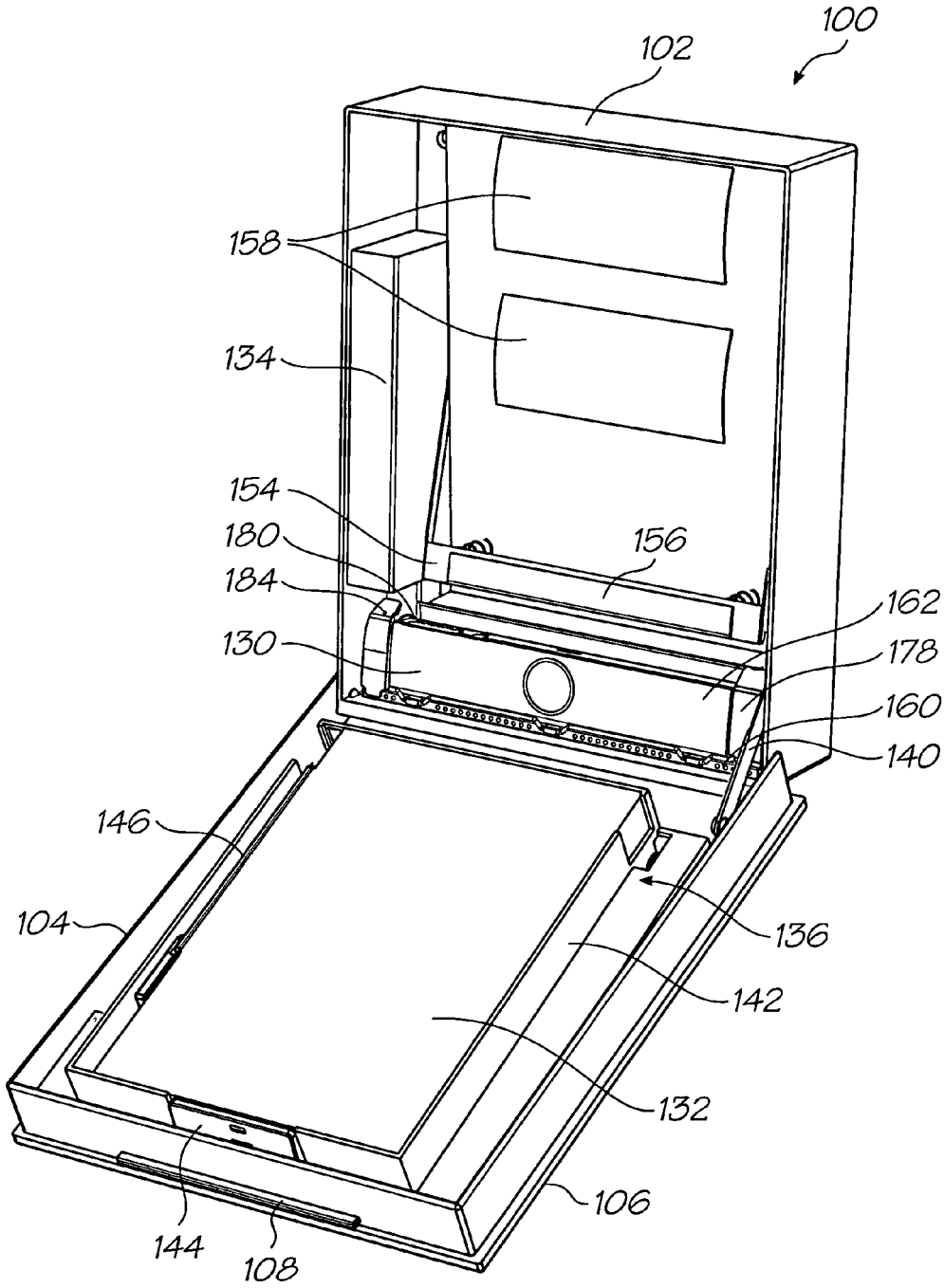
FIG. 10 illustrates an open position of a print media source tray assembly of the printer as shown in FIG. 9 loaded with A4 print media.

Referring to FIG. 10, the source tray assembly 104 is arranged to be capable of storing print media 132 for printing in a paper tray portion 136 thereof. The print media 132 may be provided in the form of variously sized print media stacks each comprising of about 250 sheets, and up to 500 sheets, i.e., a ream of paper, of up to 300 gsm paper. For example, in FIG. 10 A4 paper is held by the source tray assembly 104. However, photographic print media, e.g., 4"×6" paper, and other media may be held. In the following description the print media for use in the printer 100 is referred to as paper, however other forms of print media are applicable.

The printer 100 thus constructed is intended for use as a printer which is capable of printing information onto paper at a rate of at least 30 pages per minute (ppm), preferably at least 60 ppm, with a printing resolution providing for so-called photographic quality printing of at least 1200 dots per inch (dpi), preferably at least 1600 dpi. The manner in which the printer 100 operates in order to provide these capabilities whilst being wall mounted will now be discussed.

Referring again to FIGS. 9 and 10, a cover portion 138 is provided which "snaps" into the source tray assembly 104 so as to form the outer surface thereof. The cover portion 138 comprises cut-out portions 114*a* and 116*a* for accommodating the user interface 114 and the data connector 116, respectively. The source tray assembly 104 is hingedly mounted to the body 102 via a hinge arrangement 140 about a pivot (not shown). The stack 132 of paper is received and held on a surface (tray) 142 of the tray portion 136 which faces the body 102 when the source tray assembly 104 is mounted thereto. That is, the stack 132 is loaded on the source tray assembly 104 by being placed on the tray 142 and is held in a desired location on the tray 142 by using a stop plate 144 and a fence plate 146 thereof.

In order to do this, a plurality of holes 142*a* are provided in the tray 142 in a matrix which provides different positions for the stop and fence plates 144 and 146. The stop plate 144 has tabs 144*a* arranged to engage with some of the plurality of holes 142*a* of the tray 142 and the fence plate 146 similarly has a tab 146*a* for engaging with some of the holes 142*a* of the tray 142. Further, the fence plate 146 may have a clipping element 146*b* which engages with a rod (not shown) provided on the tray 142, so that it is laterally slidable across the tray 142.

The tray portion 136, and consequently the source tray assembly 104, is made to a size sufficient to accommodate the maximum sized paper to be used with the printer 100. In the embodiment shown in the figures, the maximum paper size that may be accommodated in this way is A4 paper. However, the printer 100 may be arranged to accommodate a different maximum print media size. Different sized paper is accommodated in the source tray assembly 104 as shown in FIGS. 9 and 10 by moving the stop and fence plates 144 and 146 into varying positions via the holes 142*a*. Those skilled in the art will understand that the above-described arrangement to accommodate variously sized paper stacks within the source tray assembly 104 is merely an example, and alternative arrangements and mechanisms may be used in accordance with the present invention to securely hold such paper stacks.

The source tray assembly 104 also houses a picker assembly 148 which is used to pick-up and separate the individual sheets of paper from the stack 132 so as to be advanced to the print engine 130. The picker assembly 148 may comprise at least one "D-type" drive rollers 150, shown most clearly in the cross-sectional view of the printer 100 in FIG. 11, which is driven by a motor 152. A plurality of drive rollers 150 may be provided as shown in FIG. 9 so as to extend across the sheets of the stack 132, however a single drive roller 150 having a length which achieves this is also within the scope of the present invention.

Figure 11:
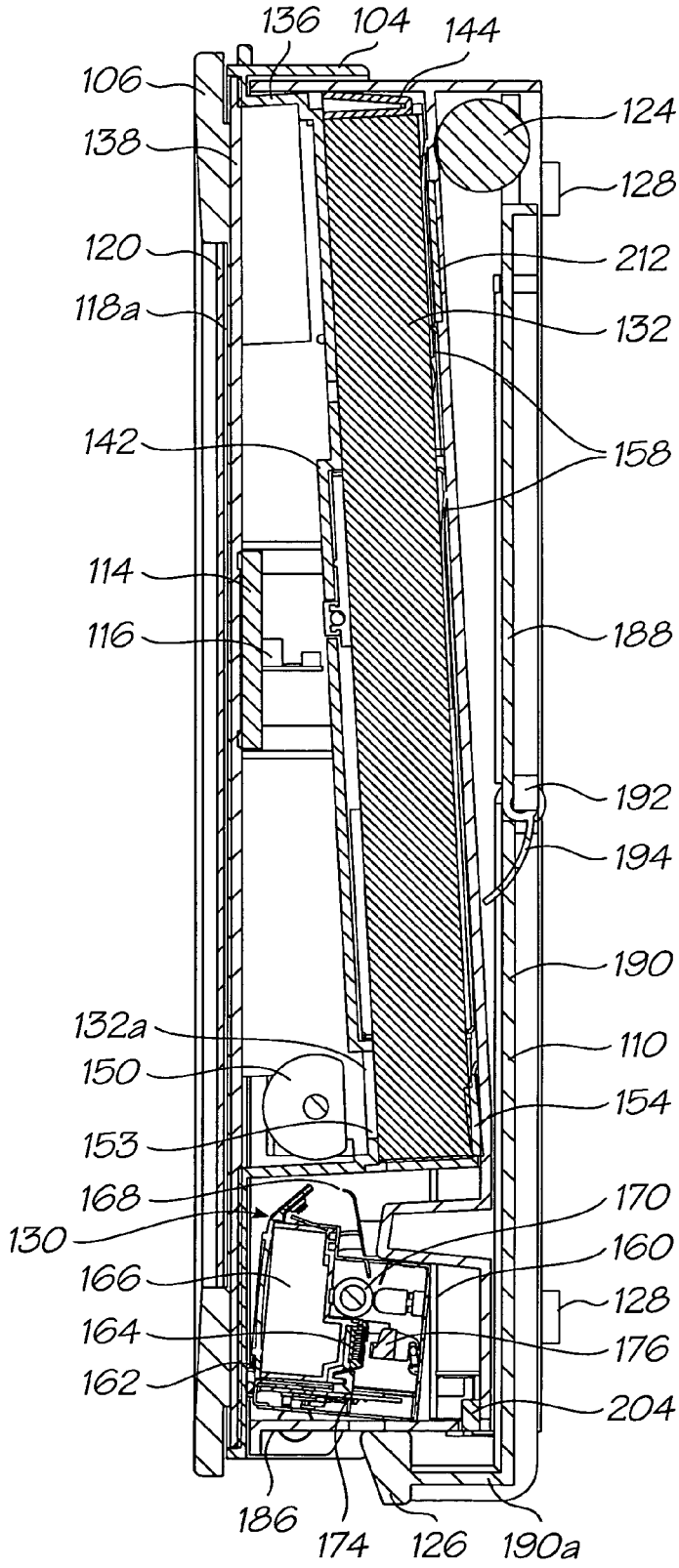
FIG. 11 shows a cross-sectional view of the printer taken along the line A-A of FIG. 2.
Figure 12:
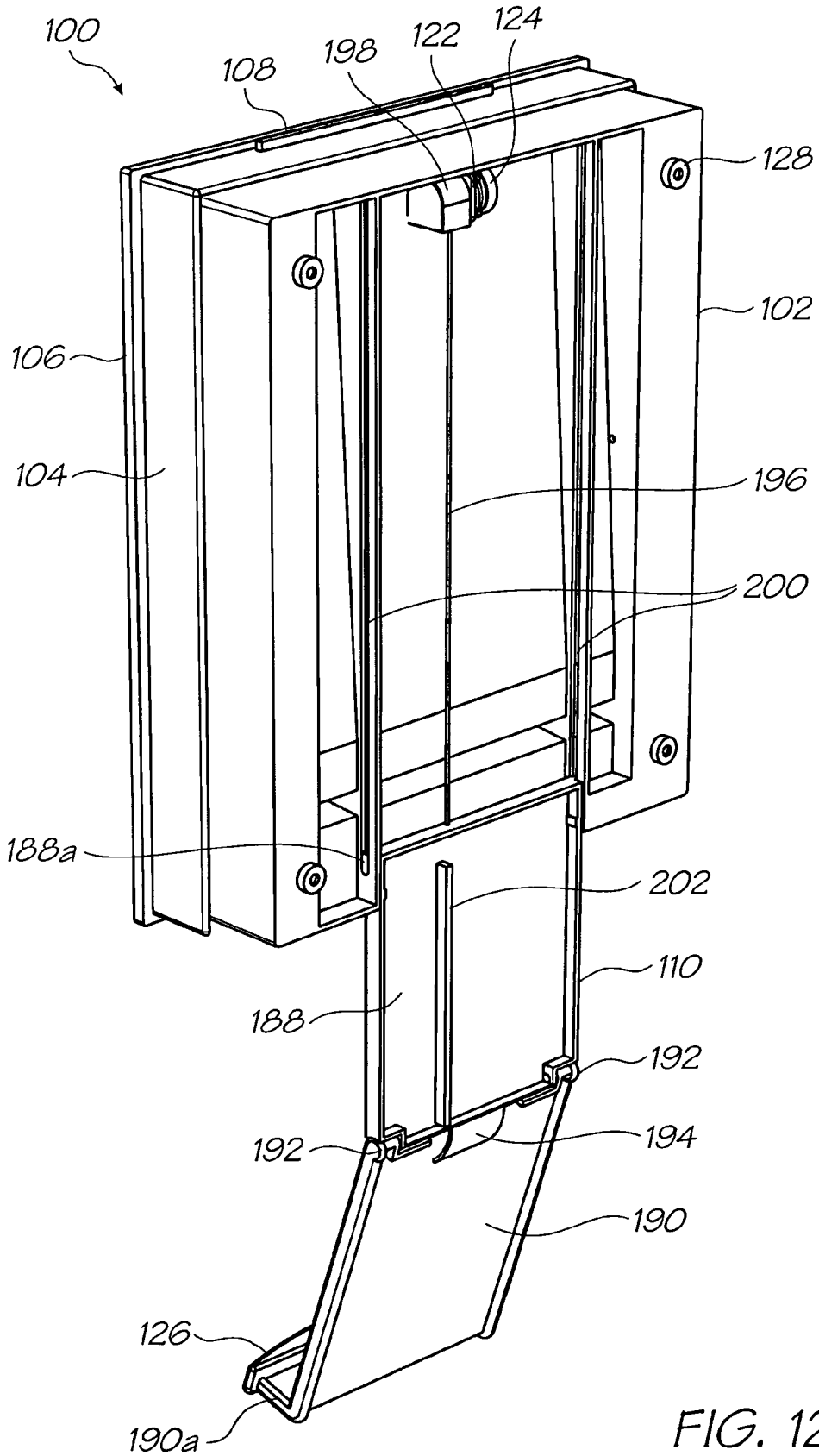
FIG. 12 shows a rear perspective view of the printer of FIG. 1 illustrating a print media collector thereof.

In the arrangement shown in FIG. 11, the drive rollers 150 are rotated clockwise by the motor 152 so as to pick-up a bottommost sheet 132*a* from the stack 132 which is exposed to the picker assembly 148 through one or more gaps 153 provided in the tray 142 which correspond with the position of the drive roller(s) 150 (see also FIG. 9). The operation and speed of the drive rollers 150 is controlled via control circuitry (not shown) of the printer 100. The drive rollers 150 have a surface, such as rubber, which grips the sheets of paper in the stack 132. It will be understood that other types of picker mechanism could be used in accordance with the present invention.

As can be seen in FIG. 11, the tray 142 is angled from the horizontal by about 80° to 85° (i.e., 5° to 10° from the vertical) in order to position the bottommost sheet 132*a* of the stack 132 so that it may be readily picked-up for advancement to the print engine assembly 130 for printing by the drive rollers 150 of the picker assembly 148. During the printing process, the size of the stack 132 will change as the sheets of paper are consumed. Thus, the stack 132 is spring loaded towards the picker assembly 148 by a spring mechanism 154 provided in the inner section of the body 102 which acts against the stack 132 so as to urge its bottom edge into the position shown in FIG. 11.

In this pick-up process, when the stack 132 approaches its depleted state, there will be a situation where only a small number of sheets remain, e.g., two sheets. In this situation it is possible that all of these sheets will be picked-up together creating a multiple feed, i.e., more than a single sheet fed through the picker assembly 148 to the print engine assembly 130 for printing at any one time, which is not desired since jams and/or distorted prints can occur. This situation may occur since the friction between the sheets may be greater than the friction between the bottommost sheet 132*a* of the stack 132 and the drive rollers 150. Thus, a pad 156 is provided on the spring mechanism 154 so as to present a higher friction surface between the last sheet of paper in the stack 132 and the spring mechanism 154 than that between the last and second-to-last sheets of paper in the stack 132. The pad 156 may be formed of a material, such as rubber, felt, cork, etc.

As can be seen from FIGS. 9 and 10, the inner section of the body 102 comprises foils 158 which act as retaining members for the sheets within the stack 132. The foils 158 extend across at least part of the width of the inner section of the body 102 so as to project out from the surface of the inner section of the body 102. The foils 158 are made from a flexible material, such as plastic, but are secured so as to be resilient to small forces. The purpose of the foils 158 is as follows.

Since the tray 142 is angled "sagging" in the paper of the stack 132 may occur which can cause errors in the pick-up process or individual sheets to separate from the stack 132 which can cause jams. Therefore, the foils 158 are provided to apply a retaining force against the sheets in the stack 132 which urges them back against the stack 132 so as to substantially prevent such sagging. The resilient nature of the foils 158 provides the appropriate retaining force to maintain the sheets in position. Whilst two foils 158 are shown a greater or lesser number of foils is within the scope of the present invention as to are foils having recessed portions along their length rather than being continuous, so long as the arrangement thereof provides the securing of the sheets in the stack 132.

Having been successfully picked-up by the picker assembly 148, the bottommost sheet 132*a* advances to the print engine assembly 130 for printing. The print engine assembly 130 may be of the type described in the present Applicant's U.S. patent application Ser. Nos. 10/760,254 to 10/760,258, the disclosures of which are all incorporated herein by reference. These applications have been identified by their filing docket number, which will be substituted with the corresponding application number, once assigned. As such, the print engine assembly 130 is generally comprised of two parts: a cradle unit 160 and a cartridge unit 162, shown variously in FIGS. 9 to 11.

The cartridge unit 162 comprises a printhead 164 for printing on a sheet of paper as it passes thereby and at least one ink handling and storage reservoir 166 for providing ink to the printhead 164. The printhead 164 is a pagewidth printhead, which means that no scanning of the printhead 164 across the sheets is required. This enables high-speed printing to be performed. Those skilled in the art however will understand that the present invention is applicable to printers employing other types of printheads. Further, as shown in FIG. 11, the cartridge unit 162 comprises a single printhead 164. However, a duplex printer may be used employing a cartridge unit having two pagewidth printheads aligned so that printing surfaces thereof oppose each other with a gap therebetween for accommodating the sheet of paper.

The cradle unit 160 comprises a guide plate 168 for guiding the sheet 132*a* into the print engine 130, a roller assembly 170 and an associated motor 172 for advancing and controlling the trajectory and speed of the sheet 132*a* as it passes the printhead 164, drive electronics 174 for controlling the printing performed by the printhead 164 and a capping unit 176 for capping the printhead 164 when printing is not being performed.

The cradle unit 160 is removably mounted within the body 102 and the cartridge unit 162 is removable received within the cradle unit 160, which allows for easy replacement of the printhead 164 and the ink storage reservoirs 166, and associated components, when necessary. A release latch 178 is provided for controlling this removal which can be easily manipulated by a user. In this way, the complexity of the printer 100 is minimised which provides ease of use.

By providing a plurality of the ink handling and storage reservoirs 166 in the cartridge unit 162 different coloured ink and associated printing fluids, such as fixative for assisting the setting of the printed ink, can be stored. The printhead 164 draws the ink from these reservoirs 166 in order to print on the sheets. A refill port 180 is incorporated in the cartridge unit 162 to which a refill cartridge (not shown) can be applied so as to refill the reservoirs 166 with the particular types of inks which may have been depleted through printing. In order to facilitate this refilling process an indicator light 184, such as an LED, is provided on the cradle unit 160 which is controlled to indicate to a user when refilling is needed and/or has been completed in the manner described in the present Applicant's above-mentioned applications. The need for refilling can also be indicated to a user via the user interface 114 or by print manager software loaded on the user's personal computer (PC) connected to the printer 100, as discussed later.

The mounted position of the cradle unit 160 is such that the leading edge of the sheet 132*a* being fed from the drive rollers 150 of the picker assembly 148 and guided by the guide plate 168 enters the roller assembly 170 of the cradle unit 160 so as to be advanced past the printhead 164 to be printed under action of the roller assembly 170 (and, in part, of the drive rollers 150). The leading edge of the sheet 132*a* progresses through the cradle unit 160 and following printing exits the body 102 via an exit slot 186 (see FIGS. 5, 6 and 11).

During the printing process, the trailing edge of the sheet 132*a* is transferred from being driven by the drive rollers 150 to being driven only by the roller assembly 170 of the print engine assembly 130 due to the D-type drive rollers 150 used in the picker assembly 148. Once printed, the trailing edge exits the body 102 via the exit slot 186, whereupon the printed sheet 132*a* is collected by the extended collector 110.

The extended collector 110 is shown variously in FIGS. 12 to 15. As can be seen, the collector 110 is an articulated collection tray comprising two sections, an upper section 188 and a lower section 190, attached to one another in a hinged relationship with hinges 192. The hinges 192 may be arranged so that the lower section 190 can be disengaged from the upper section 188 when a moderate force is applied thereto. The total length provided by the upper and lower sections 188 and 190 is such that the maximum sized paper can be collected whilst providing sufficient clearance between the collected paper and the bottom of the body 102 for a user to easily collect the printed sheets.

The lower section 190 is substantially L-shaped with a foot portion 190*a* of the L-shape acting as a stop surface for the collected sheets 132*a* and having the retaining portion 126 of the collector 110 attached thereto. The retaining portion 126 is used to assist in the retention of the collected sheets and the foot portion 190*a* is provided so that the consecutively released sheets 132*a* can be "squared" or "knocked-up" so as to provide a neat collection of the printed sheets 132*a*. The depth of the foot portion 190*a* is sufficient to hold a plurality of sheets, for example, the number of sheets provided within the stack 132 held by the source tray assembly 104.

When the collection tray 110 is extended, the lower section 190 is angled relative to the upper section 188 which is substantially parallel to the body 102 along its length. By arranging the collection tray 110 in this way, the sheets 132*a* ejected from the print engine assembly 130 via the exit slot 186 of the body 102 are securely collected and retained on the upper and lower sections 188 and 190 in the manner shown in FIGS. 14 and 15. That is, as each of the sheets 132*a* exits the body 102 the leading edge thereof comes into contact with the surface of the lower section 190, or the previously collected sheet held thereon, and advances until it is stopped by the foot portion 190*a* of the lower section 190. This is because, the upper section 188 of the collection tray 110 is situated behind the exit slot 186 with respect to the printer 100 mounting direction (see FIGS. 5 and 6), such that the lower section 190 is sprung forward so as to lie in the exit path of the sheets 132*a*. In this way, the sheets 132*a* are collected and held at an angle from the vertical (i.e., substantially the angle of the lower section 190) which, together with the retaining member 126, prevents the sheets 132*a* from toppling forward from the collection tray 110.

The required angle, e.g., about 5° from the vertical, is provided by a spring 194 located on the lower edge of the upper section 188 which engages with the rear surface of the lower section 190 so as to urge the lower section 190 away from the plane of the upper section 188 about the hinges 192. In the retracted position of the collection tray 110, the lower section 190 is forced to be in the plane of the upper section 188 through contact with the rear surface of the body 102, as shown in FIG. 4. In this way, the retracted tray 110 is situated within the body 102 in a compact manner. Those skilled in the art will understand that other mechanisms for securely collecting the printed sheets of paper are within the scope of the present invention, such as guiding ribs used on the surface of the collection tray for imparting lateral curvature to the sheets and the like.

In order to manoeuvre the collection tray 110 into and out of its retracted and extended positions the winding arrangement 122 is provided comprising a wire 196 connected between the upper section 188 and a winch 198 situated within the upper surface of the body 102, as shown in FIGS.

12 and 14, and the motor 124 which operates the winch 198 so as to change the length of the wire 196 by winding the wire 196 about the winch 198.

The upper section 188 has tabs 188*a* provided at the top of each of the longitudinal sides thereof which engage with running slots 200 provided within the body 102. Therefore, in operation, as the length of the wire 196 is changed by the winding arrangement 122, the upper section 188, and consequently the lower section 190, is caused to lower or climb by the tabs 188*a* sliding along the running slots 200. This winding may be controlled via the control circuitry or the drive electronics 174 of the print engine assembly 130 receiving instructions for extension/retractions via the user interface 114 or via print manager software loaded on the user's PC connected to the printer 100. Alternatively, the operation may be performed automatically in conjunction with printing being performed by the printer 100 and/or as a result of pressure sensor(s) (not shown) provided in the foot portion 190*a* of the collection tray 110 sensing that the collected printouts have been removed from the collection tray 110.

Figure 13:
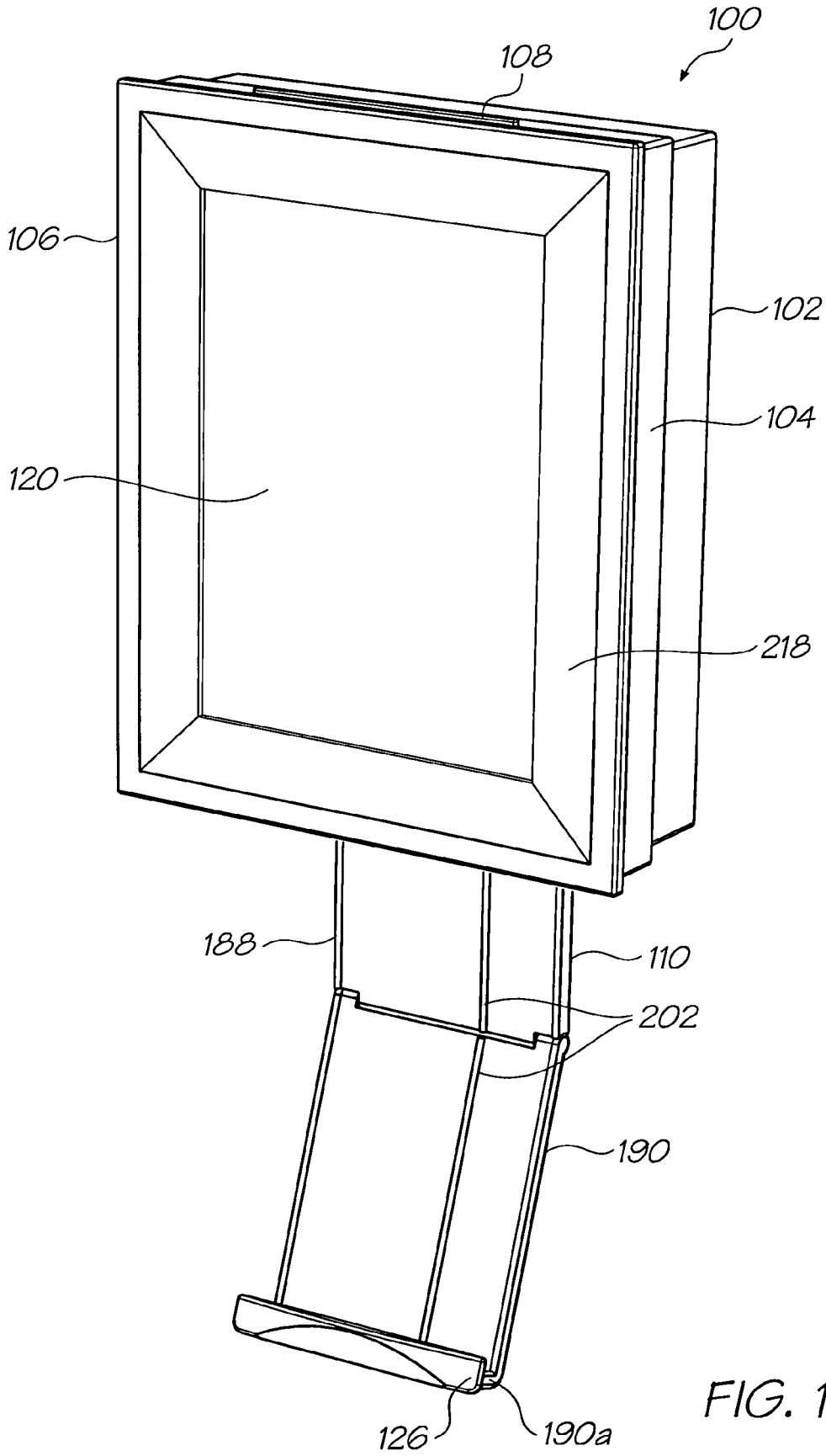
FIG. 13 shows a front perspective view of the print media collector of FIG. 12.
Figure 14:
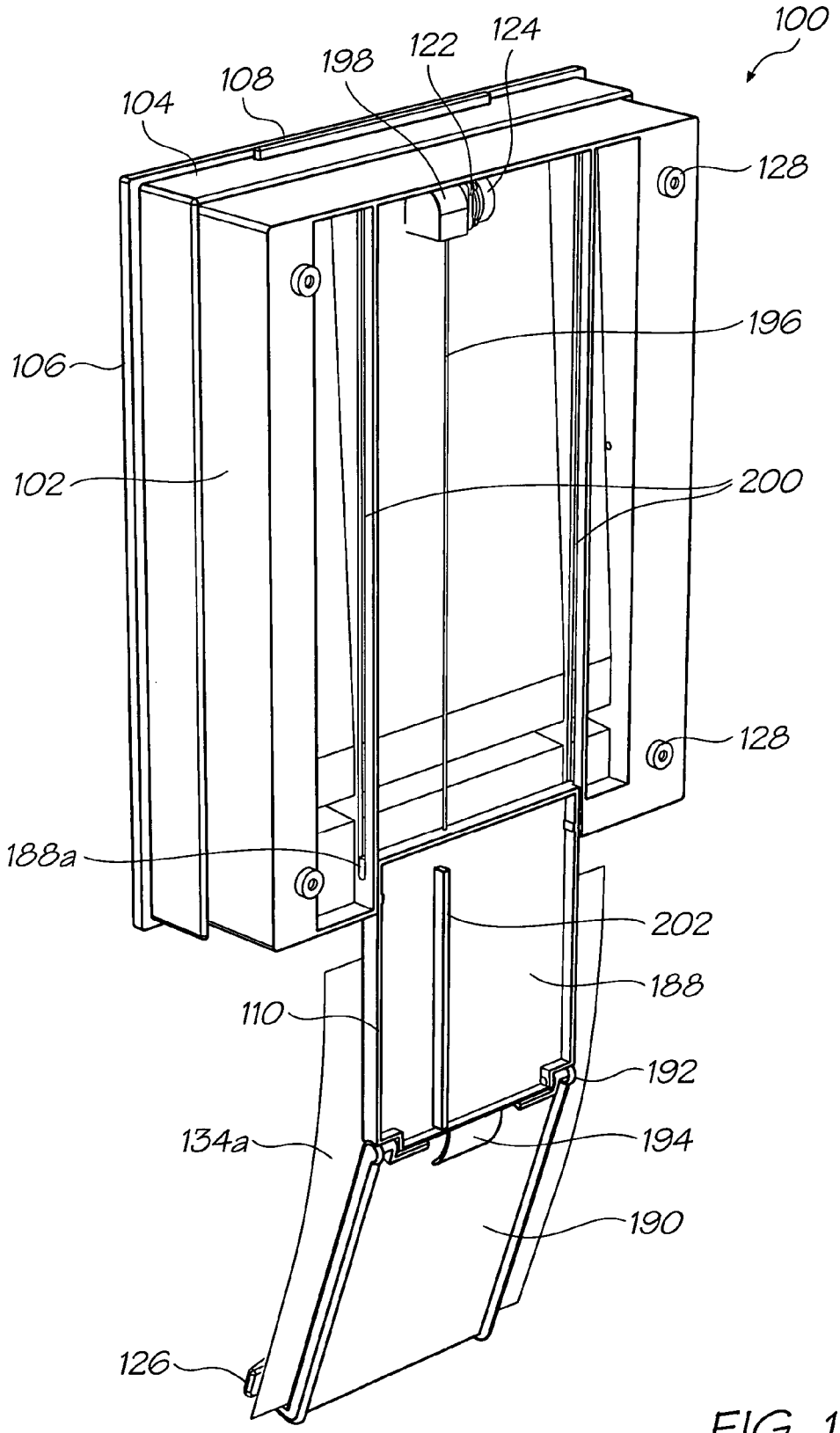
FIG. 14 illustrates the print media collector and the printer as shown in FIG. 12 with collected print media thereon.
Figure 15:
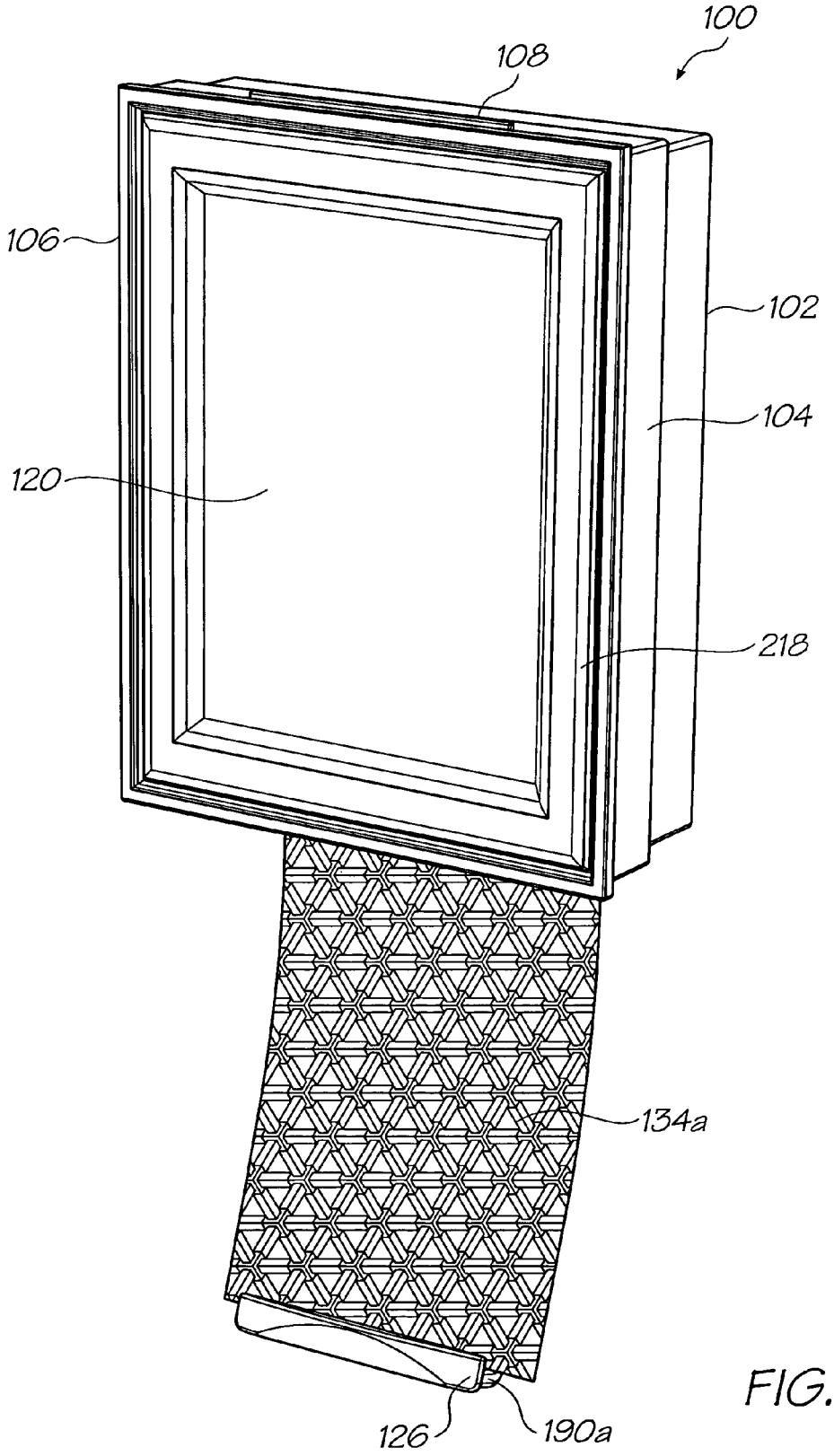
FIG. 15 illustrates the print media collector and the printer as shown in FIG. 13 with collected print media thereon.

In addition to acting as a means for collecting printouts, the collector 110 may be provided with a light pipe 202 on the upper section 188 (and also the lower section 190 if desired) as a means of providing a user of the printer 100 with an indication of the state of the printer 100 and/or the printing being performed thereby. Such a light pipe 202 may consist of a hollow transparent material, such as plastic, provided as a channel for transmitting light along the length thereof from a light source 204 (or further light pipe) located in the body 102 (see FIGS. 9 and 11). This is achieved by the inner surface of the hollow material incorporating a lining which is highly reflective for light striking its surface at certain angles and transmissive for light striking at other angles. The channel may be moulded into the shape of ribs or the like provided on the surface of the upper and lower sections 188 and 190 of the collection tray 110, as shown in FIG. 13.

The light source 204 may comprise three differently coloured light sources, such as red, green and blue light sources, which may each be a LED. The use of these different coloured light sources allows a wide spectrum of colours to be emitted by the light pipe 202 when the light sources are selectively operated either individually or in combination. Alternatively, the light source 204 may be capable of multiple colour emission, such as a tri-colour LED. As such, different coloured light can be used to indicate different states of the printer 100 and/or the printing being performed thereby by controlling the light source 204 emission with the control circuitry of the printer 100 and/or the drive electronics 174 of the print engine assembly 130.

For example, a blue light emitted by the light pipes 202 used as ribs of the collector 110 may indicate that the printer 100 is in a standby state, whilst a green light may indicate that the printer 100 is in the state of printing and a red light may indicate that the printer 100 is malfunctioning, such as there being a paper jam or there being a need for more paper or ink. Other combinations of lighting, strobing, flashing, etc could alternatively be used for such purposes. For example, increased aesthetic appeal of the printer 100 could be provided by indicating the standby state with a cycle through a spectrum of colours. The operational state of the printer 100, such as the occurrence of a paper jam, may be determined by the printer 100 in a conventional manner as understood by those skilled in the art.

Figure 16:
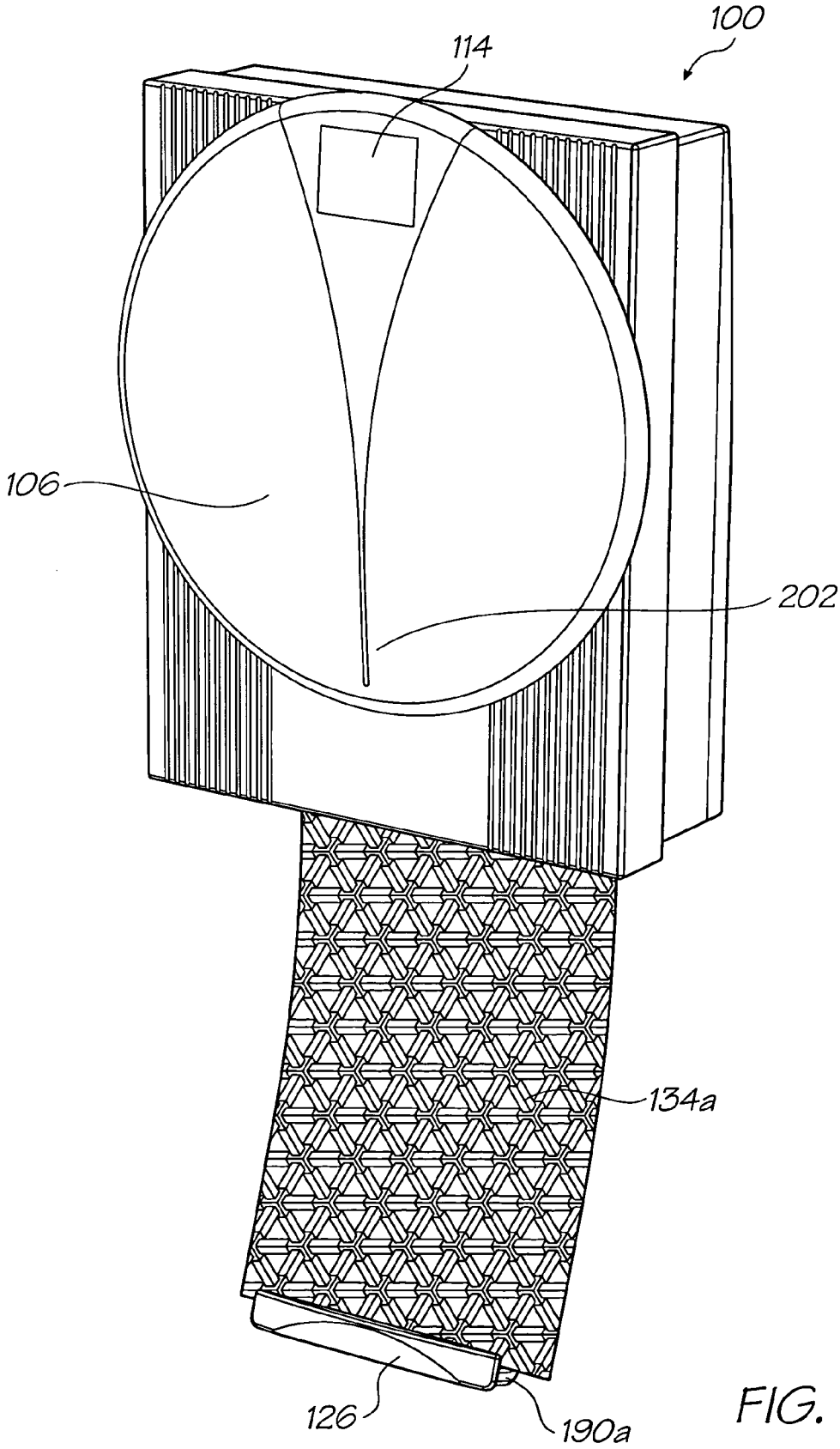
FIG. 16 illustrates the print media collector as shown in FIG. 15 with an alternative facia in accordance with the present invention.

In this arrangement, if a problem arises with the functioning of the printer 100, the light pipes 202 can be used to indicate that a problem has occurred, upon which the user can refer to the user interface 114 or the print manager software loaded on the user's PC to determine what problem has occurred, and where. Other parts of the printer 100 could also be arranged with the light pipes 202 for this purpose, such as the light source 204 itself or by providing the facia 106 of the printer 100 as stylised facia, as shown in FIG. 16, rather than one for holding prints, etc, as shown in FIG. 16, where this stylised facia 106 comprises the light pipes 202 arranged as shown and also the user interface 114. In this way, the wall mountable printer of FIG. 16 has the appearance of a printer more so than the wall mountable printer of FIG. 16, but still provides a greater aesthetic appeal than conventional printers. In this arrangement, the cover portion 138 of the source tray assembly 104 may be omitted, or rather replaced by the facia 106 with the facia 106 snapping-into the source tray assembly 104.

The user interface 114, in any form of the printer 100 of the present invention, may be a display screen, such as a liquid crystal display, as shown in FIGS. 3 and 16, used to display information about the state of the printer 100 and the like, and is preferably a touch screen via which users can operate the printer 100. This means that mechanical buttons and the like do not need to be provided on the printer 100 which facilitates a compact design of the printer 100. However, such buttons can be provided together with a simple display screen if desired.

The user interface 114 can therefore be used, either alone or in combination with the light pipes 202, to display information as to the state of the printer 100, such as the ink capacity left in the ink storage reservoirs 166 of the print engine assembly 130, the occurrence of a paper jam in the transport system, as well as command and information menus, etc for the operation of the printer 100. To achieve this, the user interface 114 may further comprise a memory and a processor (not shown) for storing software for such menus and processing commands input by the user by touching areas of the touch screen. Alternatively, such components may be provided by the drive electronics 174 of the print engine assembly 130 with suitable connections between the user interface 114 and the drive electronics 174 being provided in the body 102.

The command and information menus displayed by the user interface 114 can also be used to display information on print jobs being, or to be, performed by the printer 100. In order to receive print jobs, the printer 100 may be connected directly to a user terminal (not shown), such as a PC, or connected to a plurality of such terminals via a network, which terminal(s) transmit the print jobs to the drive electronics 174 of the print engine assembly 130 for processing and printing by the printhead 164. Such menus can also be easily adapted to display in different languages, etc, which is convenient for providing the printer 100 for use in different countries. In this way the user interface 114 is able to display information to a user regarding the operation of the printer 100 which is more useful than that which is typically provided at the print manager level on a PC connected to the printer, which is typically the case for conventional printers.

This connection external data devices/terminals and networks can be provided in a wired manner via the data connector 116 situated in the snap-in cover portion 138 of the source tray assembly 104, as shown in FIG. 3, and/or via a USB connector 206 and an Ethernet connector 208 provided in the bottom surface of the body 102, as shown in FIGS. 5 and 6, with suitable wiring between such connectors and the user interface 114 and the drive electronics 174 housed within the body 102. Alternatively, the data connection can be provided in a wireless manner by using a WIFI card 210 and/or a Bluetooth® card 212 located in the inner section of the body 102 behind the foils 158, as shown in FIGS. 9 and 11. Alternatively still, or in addition, the printer 100 may incorporate means for directly receiving image data for the print jobs by incorporating photocard slots or the like (not shown) for receiving photocards and the like so that images stored thereon can be downloaded to the printer's 100 or the drive electronics' 174 memory for direct printing.

Power for the user interface 114, the print engine assembly 130 (particularly for the motor 172 of the roller assembly 170, the printhead 164, the drive electronics 174 and the capping unit 176), the picker assembly 148 (particularly for the motor 152 of the drive rollers 150), the winding arrangement 122 (particularly the winding motor 124), the light pipes and source 202 and 204, and other electronic components of the printer 100 is supplied by the PSU 132 which is powered by an external power source (not shown) connected thereto via a power connector 214 provided in the bottom surface of the body 102, as shown in FIGS. 5 and 6. Alternatively, battery power (not shown) may be provided to the PSU 132, which coupled with the above-described wireless data communication eliminates the need for any cabling to the printer 100. Corresponding connections from the PSU 132 to the various electronic components can be provided via suitable wiring housed within the body 102.

For the wired versions of the printer 100, the provision of the data and power connections on the bottom surface of the body 102 of the printer 100 behind the exit slot 186 with respect to the mounting direction of the printer 100 (see FIG. 5) means that any cables from external devices, such as a user's PC, can be easily connected to the printer 100 without interfering with the collector 110. On the other hand, such connections could be provided on the rear surface of the body 102 coupled with means to provide such cables through the wall space to which the printer 100 is mounted.

With respect to the mounting of the printer 100 to a wall or the like, as described earlier, the mounting bosses 128 may be provided on the rear surface of the body 102 as shown in FIG. 4. In this way, a fixing means, e.g., a screw, can be engaged with the mounting bosses 128 through the wall surface so as to suspend the printer 100 from the wall, etc. Any manner of mounting is applicable so long as it is sufficient to support the combined weight of the printer 100 and the stack 132 of paper provided therein. It should be noted that the components of the printer 100 including the body 102, the source tray assembly 104, the facia 106 and the various components thereof can in the most part be moulded from lightweight material, such as plastic, so as to provide maximum flexibility in the type of mounting arrangement used.

Figure 17A:
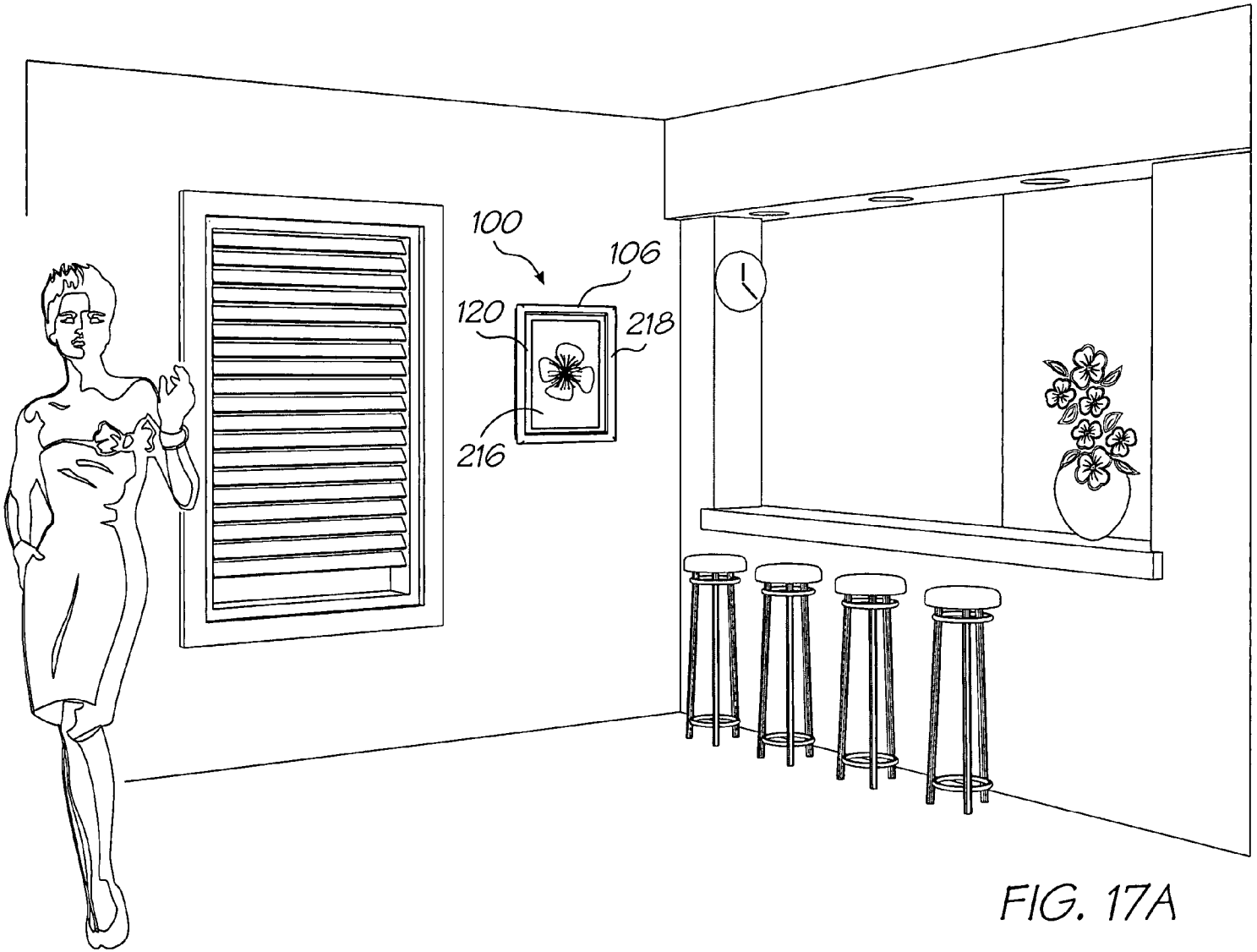
FIGS. 17A and 17B illustrate an application of the printer as shown in FIG. 4.

Once mounted, the printer 100 in its non-operational state, i.e., with the collector 110 retracted into the body 102, may appear as shown in FIG. 17A with a photo (or picture) 216 provided in the facia 106. As described earlier, in order to place the photo 216 into the facia 106, the facia 106 is hinged open from the source tray assembly 104 which is mounted to the body 102 of the printer 100 and the photo 216 is slid into the envelope portion 118 through a slot 118*a* (see FIG. 3) so as to be displayed through the transparent window 120 provided on the outer surface of the facia 106. A cut-out portion 118*b* is also provided in the envelope portion 118 for easy removal of the photo 216.

Figure 17B:
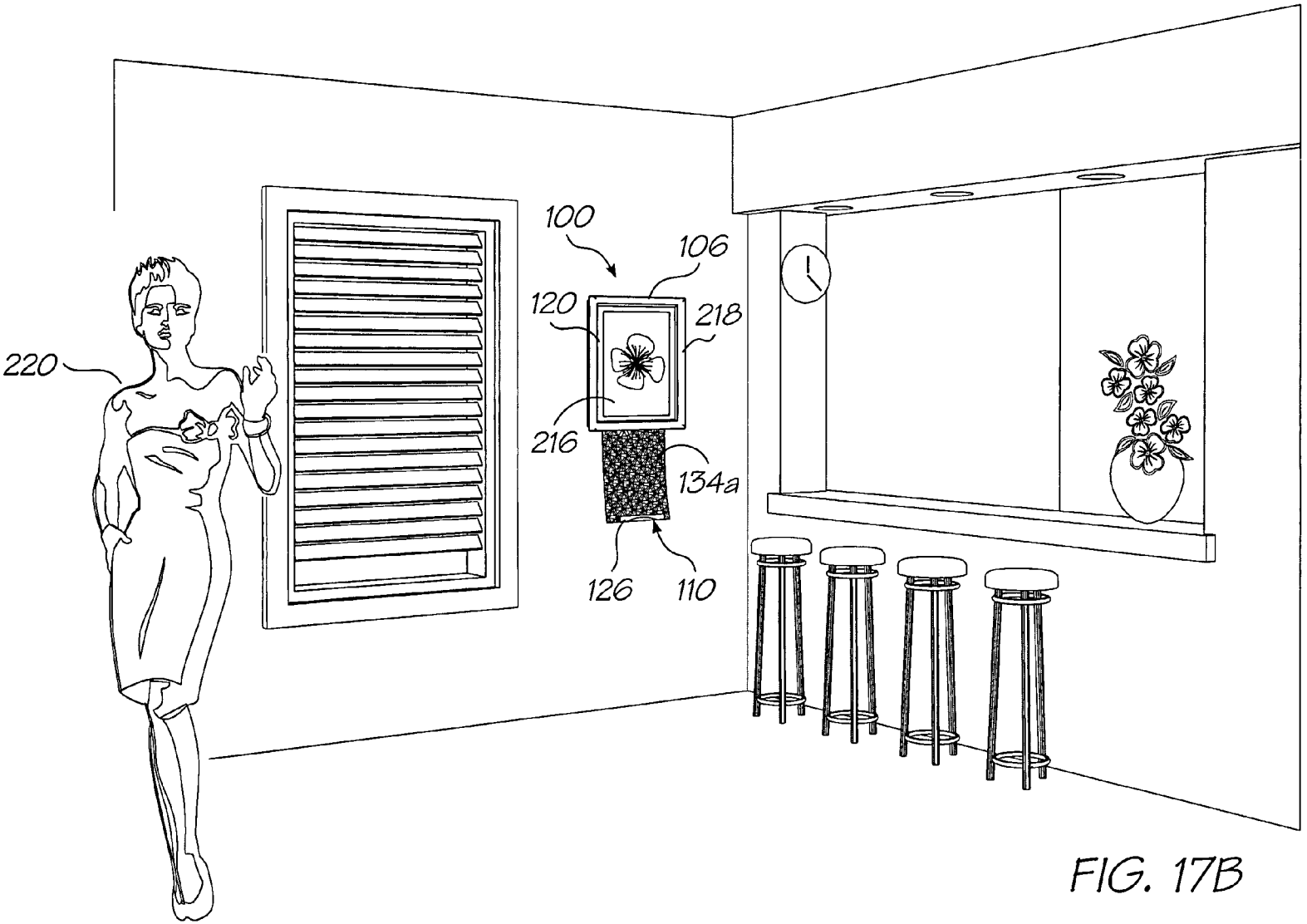

Also, as can be seen most clearly from FIG. 17A, the facia 106 is further provided with a picture frame portion 218 on the front surface thereof about the transparent window 120. In this way, when the printer 100 is in the non-operational state the appearance of the printer 100 is that of a framed picture hanging on the wall or the like. This is because, the picture frame portion 218 has a size which is substantially the same as the size of the facia 106 and front surface of the body 102 of the printer 100. Such an arrangement provides a means of enabling the printer 100 to blend into the decore of a room or office. That is, the presence of the printer 100 can be disguised until it is required to operate. Upon operation, the collector 110 is extended from the body 102 of the printer 100 as described earlier and the printouts 132*a* collected thereon for removal by a user 220, as shown in FIG. 17B. Once the printouts 132*a* have been collected the collector 110 is then retracted back into the body 102 of the printer 100 to again provide the state shown in FIG. 17A.

Figure 18:
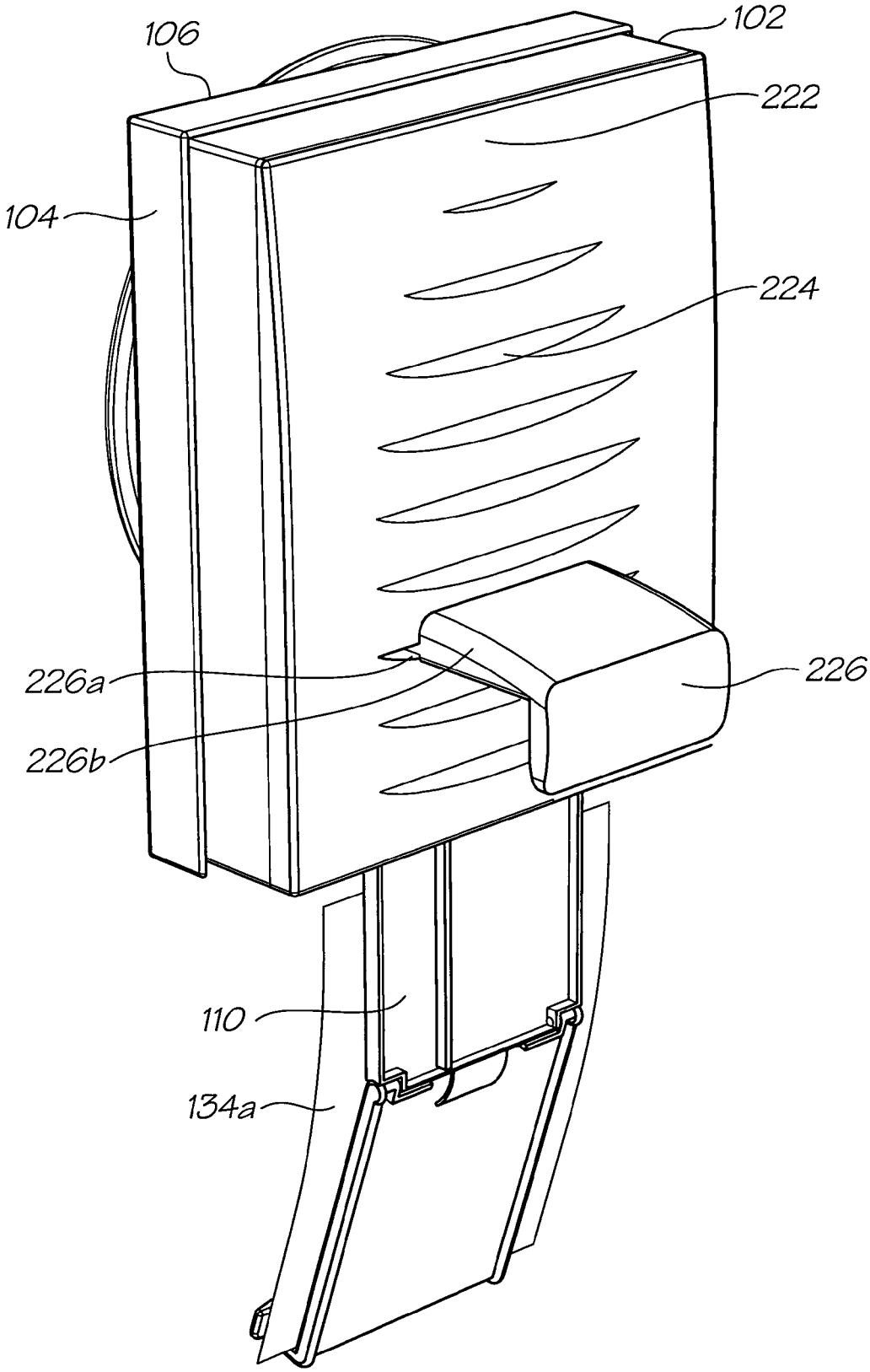
FIG. 18 illustrates the print media collector as shown in FIG. 14 with an alternative mounting arrangement of the printer in accordance with the present invention.

The printer 100 may also be adapted for mounting to other substantially vertical surfaces. For example, it may be desired to mount the printer 100 in an office environment such as on a partition wall or privacy screen of a work station and the like. In such an arrangement, the rear surface of the body 102 may be fitted with a cover 222, as shown in FIG. 18. As can be seen, the cover 222 may comprise a plurality of slots 224 in the surface thereof which are arranged to engage a mounting bracket or hook 226 for mounting the printer 100 on the partition wall. That is, an engaging portion 226*a* of the bracket 226 is arranged to engage with any one of the slots 224 at a time and a hook portion 226*b* of the bracket 226, which projects from the rear surface of the body 102 when the engaging portion 226*a* is engaged with one of the slots 224, is arranged to engage over a top surface of the partition wall. In this way, the plurality of slots 224 provide a number of reconfigurable positions of the bracket 226 which in turn provides a number of different mounting heights for the printer 100. This variety of possible printer heights provides flexibility in the mounting of the printer 100 so as to sufficiently accommodate the space required for the extended collector 110.

Figure 19A:
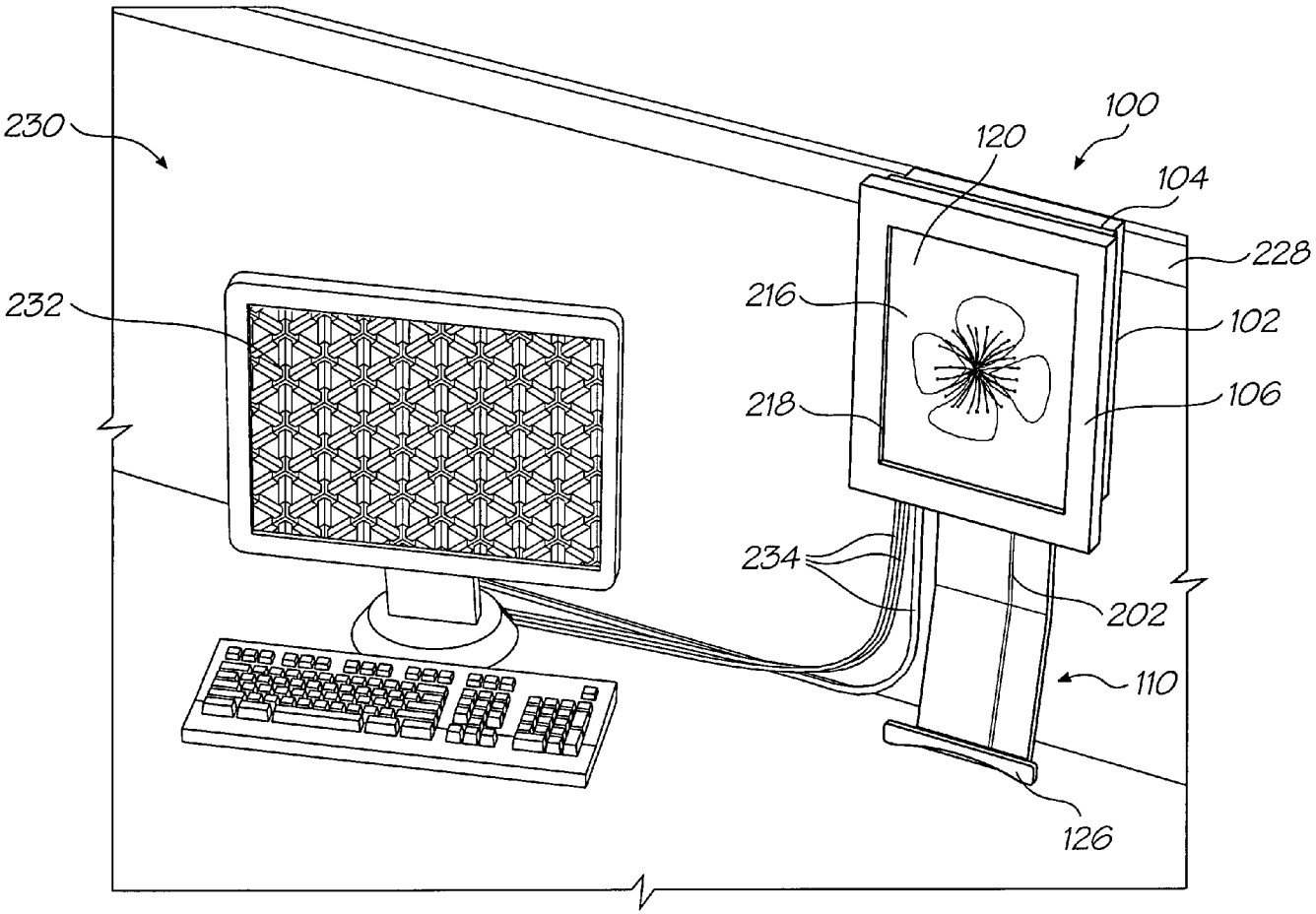
FIGS. 19A and 19B illustrate an application of the printer as shown in FIG. 18.
Figure 19B:
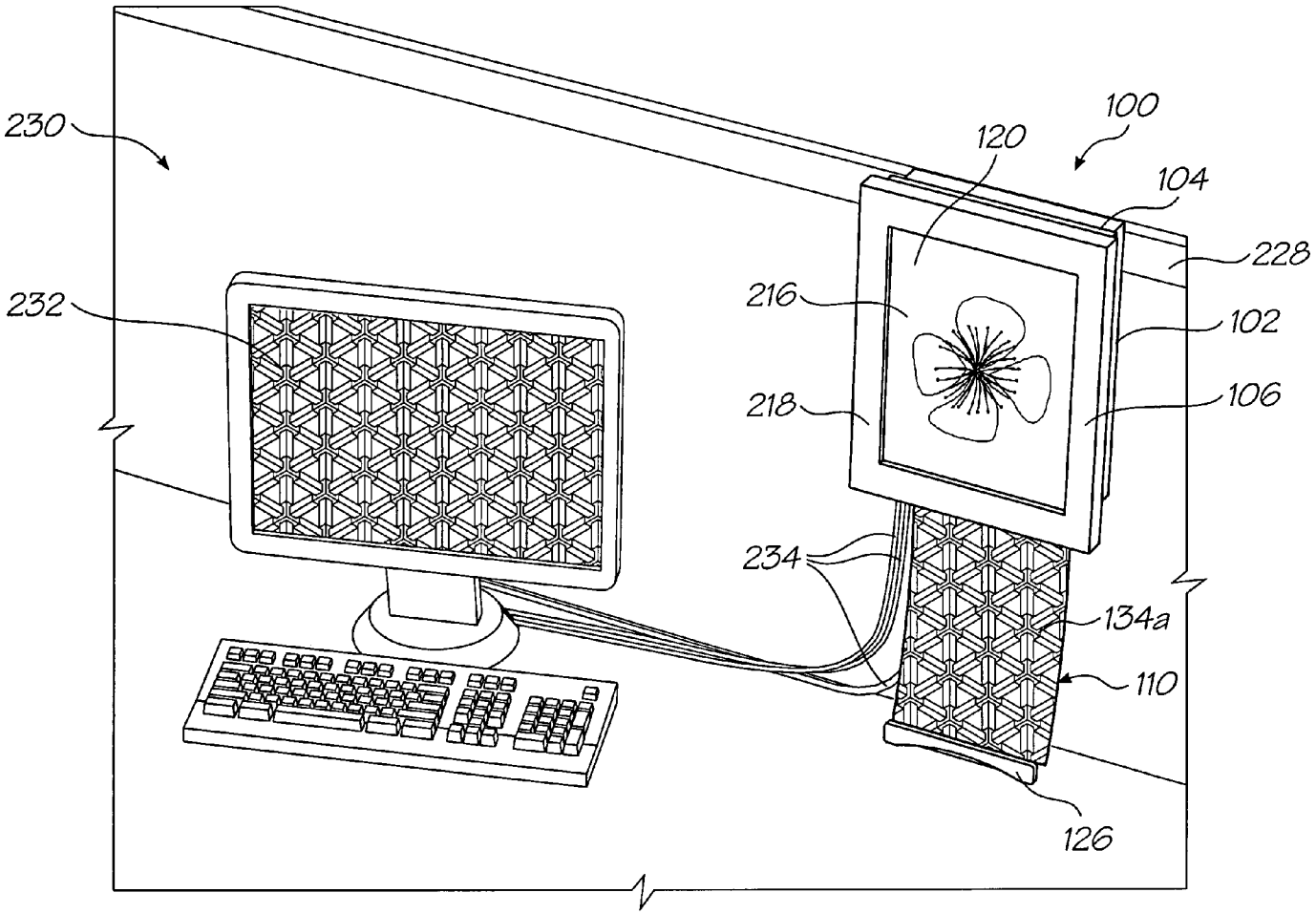

The printer 100 mounted to a partition wall 228 of a work station 230 via this mounting arrangement 224/226 is shown in FIGS. 19A and 19B with the suspended height of the printer 100 suitable for the extended collector 110. As can be seen, in this arrangement the printer 100 is provided in a non-intrusive manner in the work station 230, such that sufficient space is left on the desktop for a user's PC 232 and the like and neat connection of the PC 232 to the printer 100 is provided via cables 234, as described earlier.

The bracket 226 may be specifically configured to fit over a specific-sized partition wall 228, or provided as a "one-size-fits-all" configuration. In any event, the arrangement of the bracket 226 in the slots 224 and the attachment of the cover 222 to the body 102 must be such to sufficiently support the combined weight of the printer 100 and the stack 132 of paper provided therein. As such, the cover 222 may be snapped onto the body 102 via a sufficiently strong clipping arrangement or attached to the body 102 by any other suitable means or provided as part of the body itself.

In consideration of the various locales in which the printer 100 is able to be mounted to a wall and the like, various facia styles may be desired for the printer 100. That is, the printer 100 may be adapted so that a single printer unit 100 is able to accommodate different facias 106. For example, the picture frame portion 218 may be provided as a "snap-on" portion of the facia 106, such that picture frames of different styles can be easily provided and alternated, such as the different style picture frame portions 218 shown in FIGS. 17A and 19A. Alternatively, the facia 106 itself may be removed by providing the hinges 112 of the facia 106 with the ability to disengage from the source tray assembly 104, such that the picture frame facia 106 as shown in FIGS. 17A and 19A can be removed so as to be replaced with a facia having a different picture frame or the stylised facia 106 of FIG. 16 or any other suitable facia which will provide aesthetic appeal and/or functionality of the printer 100 in accordance with the locale in which the printer 100 is mounted.

Exemplary construction and operation of the wall mountable printer of the present invention is now described.

For the printer 100 configured to print on A4 paper as being the maximum-sized paper, the pagewidth printhead 164 of the print engine assembly 130 has a printhead width of 224 mm or 8.8 inches. In order to form this printing width the printhead 164 comprises a plurality of printhead integrated circuits (ICs) incorporating printing or ink ejecting nozzles therein, such as those described in the present Applicant's above-referenced applications RRA01US to RRA33US.

In accordance with the present invention, at least 5,000 nozzles may be incorporated to provide the required quality of printing, i.e., at least 1600 dpi, at the high-speed of at least 30 ppm, preferably at least 60 ppm. However, depending upon the printing quality and speed required, the printhead may comprise at least 10,000 nozzles, preferably at least 20,000 nozzles, and more preferably at least 50,000 nozzles in higher-speed, higher-quality printing applications.

These nozzles are arranged as a two-dimensional array across the width of the printhead so as to eject ink, and other printing fluids such as fixative, onto the surface of the passing print media in order to print images thereon. Each of the nozzles corresponds to a printed dot on the print media, and therefore the larger the number of nozzles and the greater the packing density thereof in the printhead the closer the printed dots, and therefore the higher the resolution of the printing. The drive electronics 174 receives and processes image data from an external data source, via one or more of the data connectors 116, 206 and 208 or data devices 210 and 212, and drives the nozzles of the printhead in accordance with the processed image data (explained in more detail later).

With respect to the type of nozzle systems which are applicable for the printhead 164, any type of ink jet nozzle array which can be integrated on a printhead IC is suitable. That is, systems such as a continuous ink system, an electrostatic system and a drop-on-demand system, including thermal and piezoelectric types, can be used.

Regarding a thermal drop-on-demand system, there are various types known which typically include ink reservoirs adjacent the nozzles and heater elements in thermal contact therewith. The heater elements heat the ink which creates gas bubbles therein. The gas bubbles generate pressures in the ink causing droplets to be ejected through the nozzles onto the print media. The amount of ink ejected onto the print media by each nozzle and when this occurs is controlled by the drive electronics. Such thermal systems impose limitations on the type of ink that can be used however, since the ink must be resistant to heat, and also require a cooling process which can reduce the optimum printing speed.

Regarding a piezoelectric drop-on-demand system, various types are also known which typically use piezo-crystals arranged adjacent the ink reservoirs which are caused to flex when an electric current flows therethrough. This flexing causes droplets of ink to be ejected from the nozzles in a similar manner to the thermal systems described above. Such piezoelectric systems allow more control over the shape and size of the ink droplets than the thermal systems and the ink does not have to be heated and cooled between cycles, giving a greater range of available ink types.

Further, a micro-electromechanical system (MEMS) of nozzles could be used which includes thermo-actuators which cause the nozzles to eject ink droplets. Such nozzle systems are described in the present Applicant's following co-pending and granted applications:

U.S. Pat. Nos. 6,188,415; 6,209,989; 6,213,588; 6,213,589; 6,217,153; 6,220,694; 6,227,652; 6,227,653; 6,227,654; 6,231,163; 6,234,609; 6,234,610; 6,234,611; 6,238,040; 6,338,547; 6,239,821; 6,241,342; 6,243,113; 6,244,691; 6,247,790; 6,247,791; 6,247,792; 6,247,793; 6,247,794; 6,247,795; 6,247,796; 6,254,220; 6,257,704; 6,257,705; 6,260,953; 6,264,306; 6,264,307; 6,267,469; 6,283,581; 6,283,582; 6,293,653; 6,302,528; 6,312,107; 6,336,710; 6,362,843; 6,390,603; 6,394,581; 6,416,167; 6,416,168; 6,557,977; 6,273,544; 6,299,289; 6,299,290; 6,309,048; 6,378,989; 6,420,196; 6,425,654; 6,439,689; 6,443,558; and 6,634,735, U.S. patent application Ser. No. 09/425,420, U.S. Pat. Nos. 6,623,101; 6,406,129; 6,457,809; 6,457,812; 6,505,916; 6,550,895; 6,428,133; 6,305,788; 6,315,399; 6,322,194; 6,322,195; 6,328,425; 6,328,431; 6,338,548; 6,364,453; 6,383,833; 6,390,591; 6,390,605; 6,417,757; 6,425,971; 6,426,014; 6,428,139; 6,428,142; 6,439,693; 6,439,908; 6,457,795; 6,502,306; 6,565,193; 6,588,885; 6,595,624; 6,460,778; 6,464,332; 6,478,406; 6,480,089; 6,540,319; 6,575,549; 6,609,786; 6,609,787; 6,612,110; 6,623,106; 6,629,745; 6,652,071; 6,659,590, U.S. patent application Ser. Nos. 09/575,127; 09/575,152; 09/575,176; 09/575,177; 09/608,780; 09/693,079; 09/693,154; 09/693,735; 10/129,433; 10/129,437; 10/129,503; 10/407,207; and 10/407,212, 10/683,064 and 10/683,041, U.S. patent application Ser. Nos. 10/302,274; 10/302,297; 10/302,577; 10/302,617; 10/302,618; 10/302,644; 10/302,668; 10/302,669; 10/303,312; 10/303,348; 10/303,352; and 10/303,433, and Ser. Nos. 10/728,804 to 10/728,779, the disclosures of which are all incorporated herein by reference. Some of the above applications have been identified by their filing docket number, which will be substituted with the corresponding application number, once assigned.

Description of an exemplary MEMS nozzle system applicable to the printhead 164 is provided below, as is an exemplary manner in which the drive electronics processes the image data and drives such a nozzle system, with reference the FIGS. 20 to 33.

Figure 20:
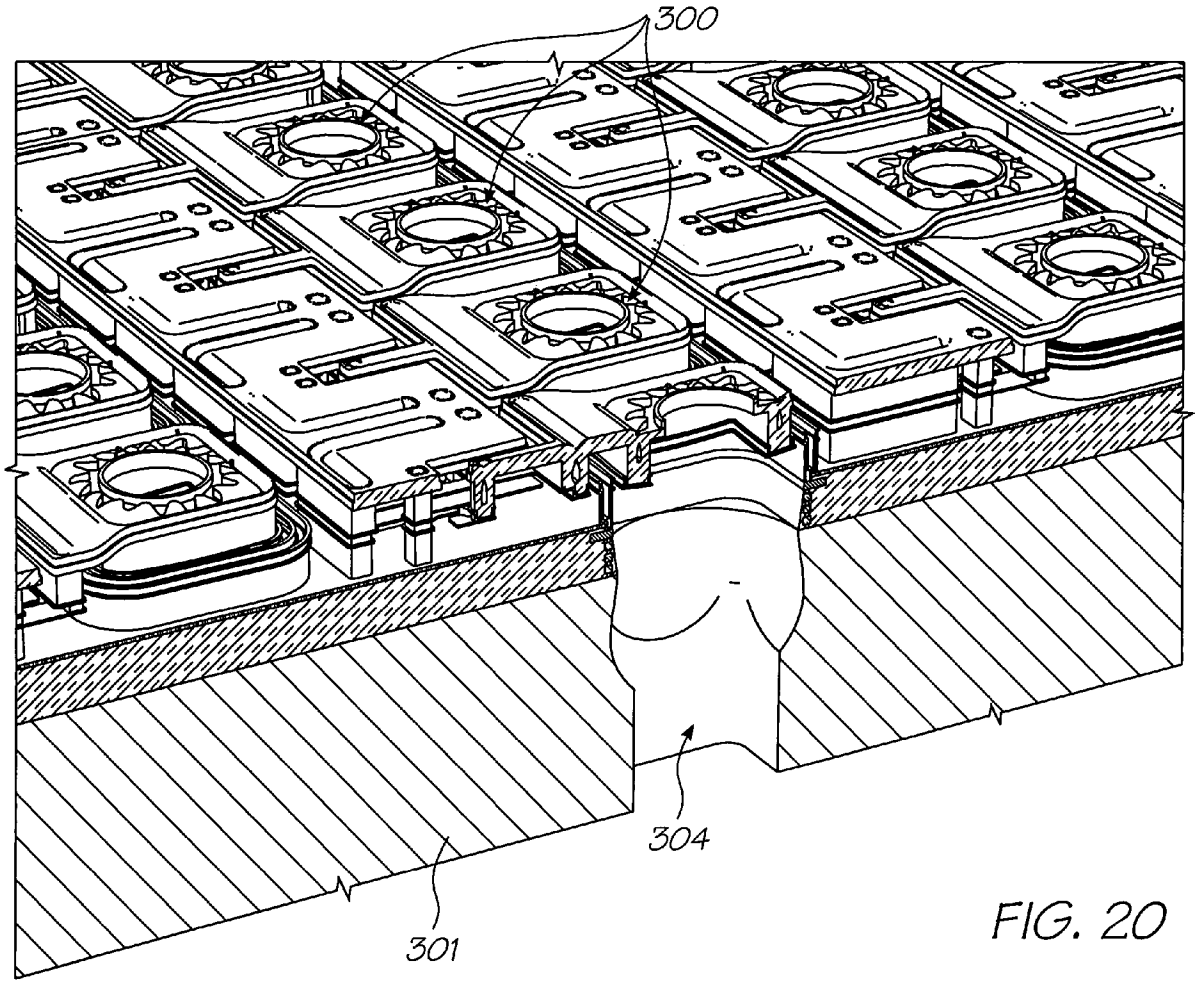
FIG. 20 shows a perspective view (partly in section) of a portion of a nozzle system of a printhead integrated circuit that is incorporated in a printhead of the printer of FIG. 1.

FIG. 20 shows an array of nozzle arrangements 300. The nozzle arrangements 300 shown are identical, however different nozzle arrangements may used which are fed with different colored inks and fixative. Preferably, the printhead 164 is configured with the nozzle arrangements 300 in rows, with one row each to print in one of five colours: Cyan; Magenta; Yellow; blacK ("CMYK"); and InfraRed ("IR"), and one row to print Fixative ("F"). CMY is provided for regular colour printing, K is provided for black text, line graphics and greyscale printing, IR is provided for applications requiring "invisible" printing, and F is provided to assist in the prevention of smudging of the printouts at high-speed.

The printhead 164 can however be adapted to print using any desired number of colours, and can comprise a monolithic printhead IC or require multiple substrates depending upon implementation. Further, the rows of the nozzle arrangements 300 are staggered with respect to each other, allowing closer spacing of ink dots during printing than would be possible with a single row of nozzles. The multiple rows also allow for redundancy (if desired), thereby allowing for a predetermined failure rate per nozzle.

Figure 21:
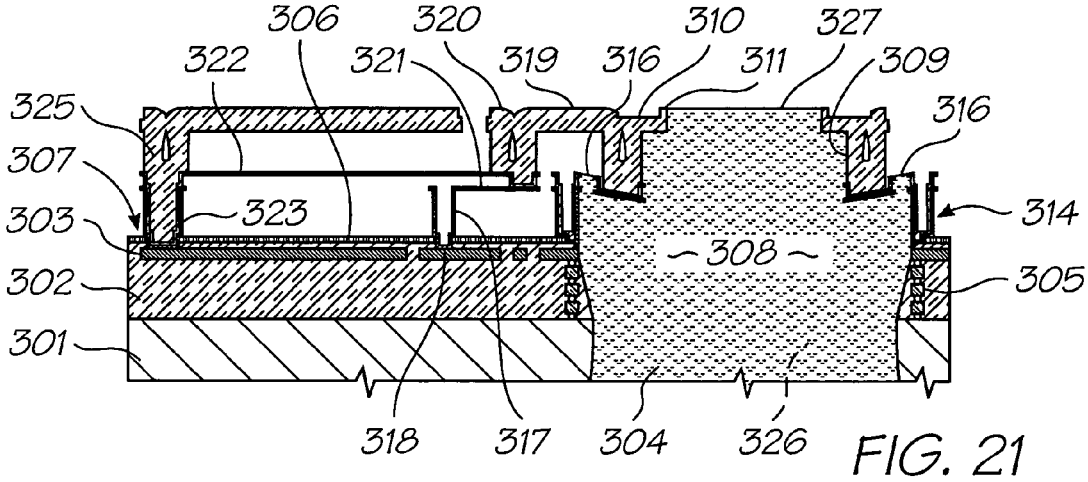
FIG. 21 shows a vertical sectional view of a single nozzle (of the nozzle system shown in FIG. 20) in a quiescent state.

The printhead ICs of the printhead 164 are manufactured using an integrated circuit fabrication technique and, as previously indicated, embody a micro-electromechanical system (MEMS). Referring to FIG. 21, which shows a single nozzle, each printhead IC includes a silicon wafer substrate 301 and CMOS microprocessing circuitry formed thereon. This is done by depositing a silicon dioxide layer 302 on the substrate 301 as a dielectric layer and aluminium electrode contact layers 303 on the silicon dioxide layer 302. Both the substrate 301 and the layer 302 are etched to define an ink channel 304, and an aluminium diffusion barrier 305 is positioned about the ink channel 304.

A passivation layer 306 of silicon nitride is deposited over the aluminium contact layers 303 and the layer 302. Portions of the passivation layer 306 that are positioned over the contact layers 303 have openings 307 therein to provide access to the contact layers 303.

Each nozzle includes a nozzle chamber 308 which is defined by a nozzle wall 309, a nozzle roof 310 and a radially inner nozzle rim 311. The ink channel 304 is in fluid communication with the chamber 308.

A moveable rim 312, that includes a movable seal lip 313, is located at the lower end of the nozzle wall 309. An encircling wall 314 surrounds the nozzle and provides a stationery seal lip 315 that, when the nozzle is at rest as shown in FIG. 21, is adjacent the moveable rim 312. A fluidic seal 316 is formed due to the surface tension of ink trapped between the stationery seal lip 315 and the moveable seal lip 313. This prevents leakage of ink from the chamber 308 whilst providing a low resistance coupling between the encircling wall 314 and the nozzle wall 309.

The nozzle wall 309 forms part of lever arrangement that is mounted to a carrier 317 having a generally U-shaped profile with a base 318 attached to the layer 306. The lever arrangement also includes a lever arm 319 that extends from the nozzle wall 309 and incorporates a lateral stiffening beam 320. The lever arm 319 is attached to a pair of passive beams 321 that are formed from titanium nitride and are positioned at each side of the nozzle, (best seen in FIGS. 24 and 25). The other ends of the passive beams 321 are attached to the carriers 317.

The lever arm 319 is also attached to an actuator beam 322, which is formed from TiN. This attachment to the actuator beam is made at a point which is a small, but critical, distance higher than the attachments to the passive beam 321.

Figure 23:
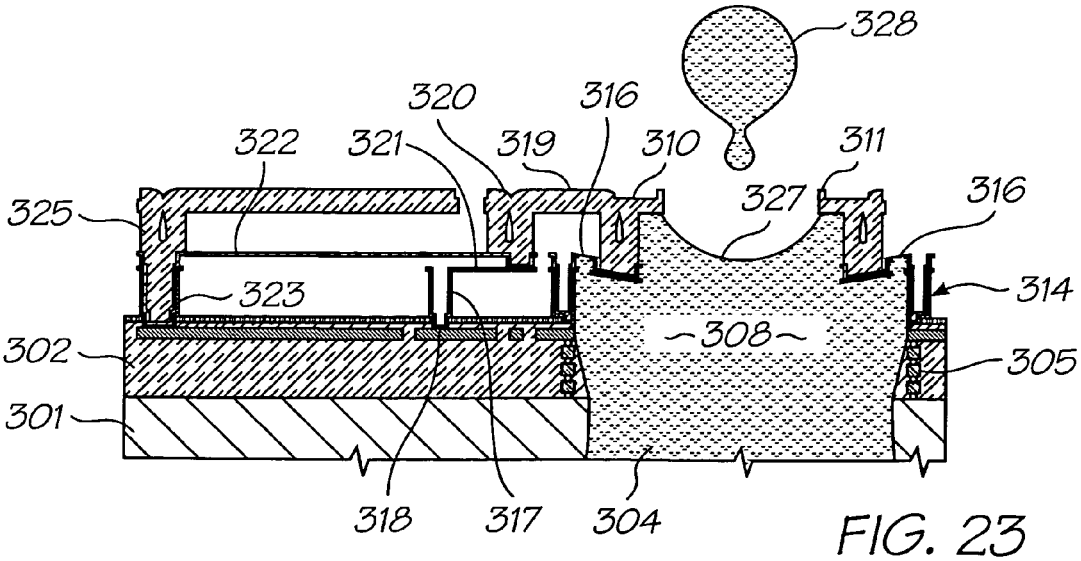
FIG. 23 shows a vertical sectional view of the nozzle of FIG. 22 at a later actuation state.
Figure 24:
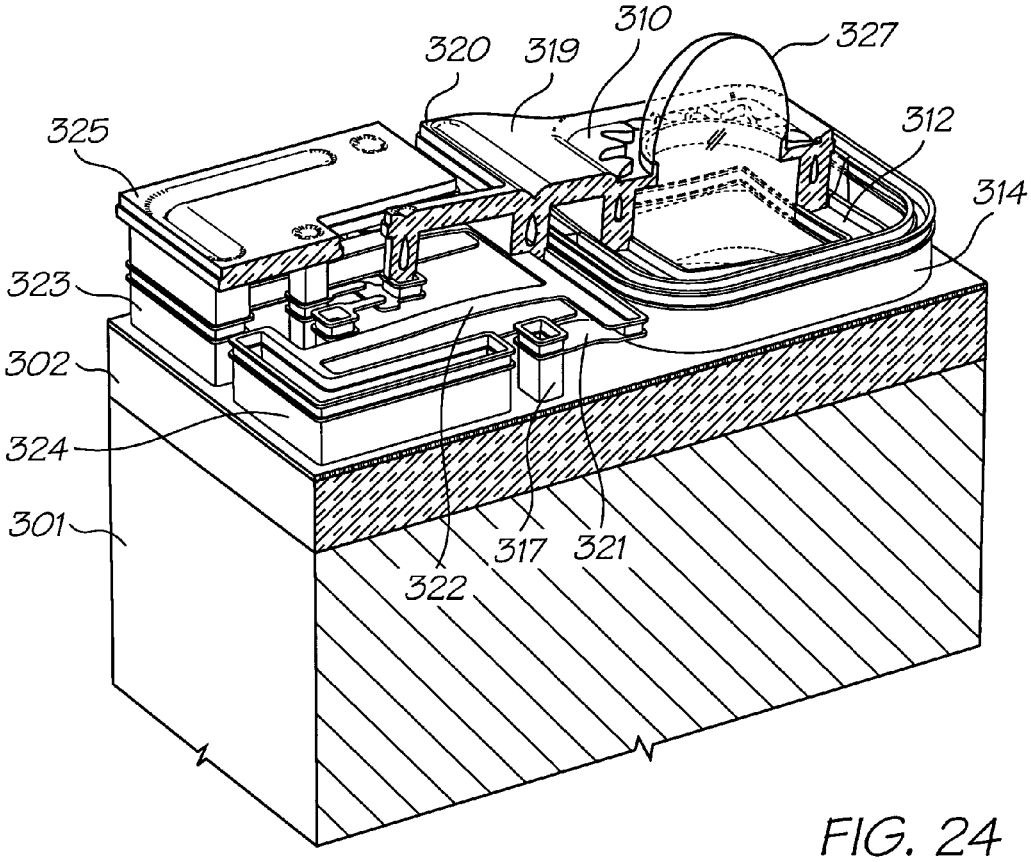
FIG. 24 shows in perspective a partial vertical sectional view of the nozzle at the initial actuation state shown in FIG. 22.
Figure 25:
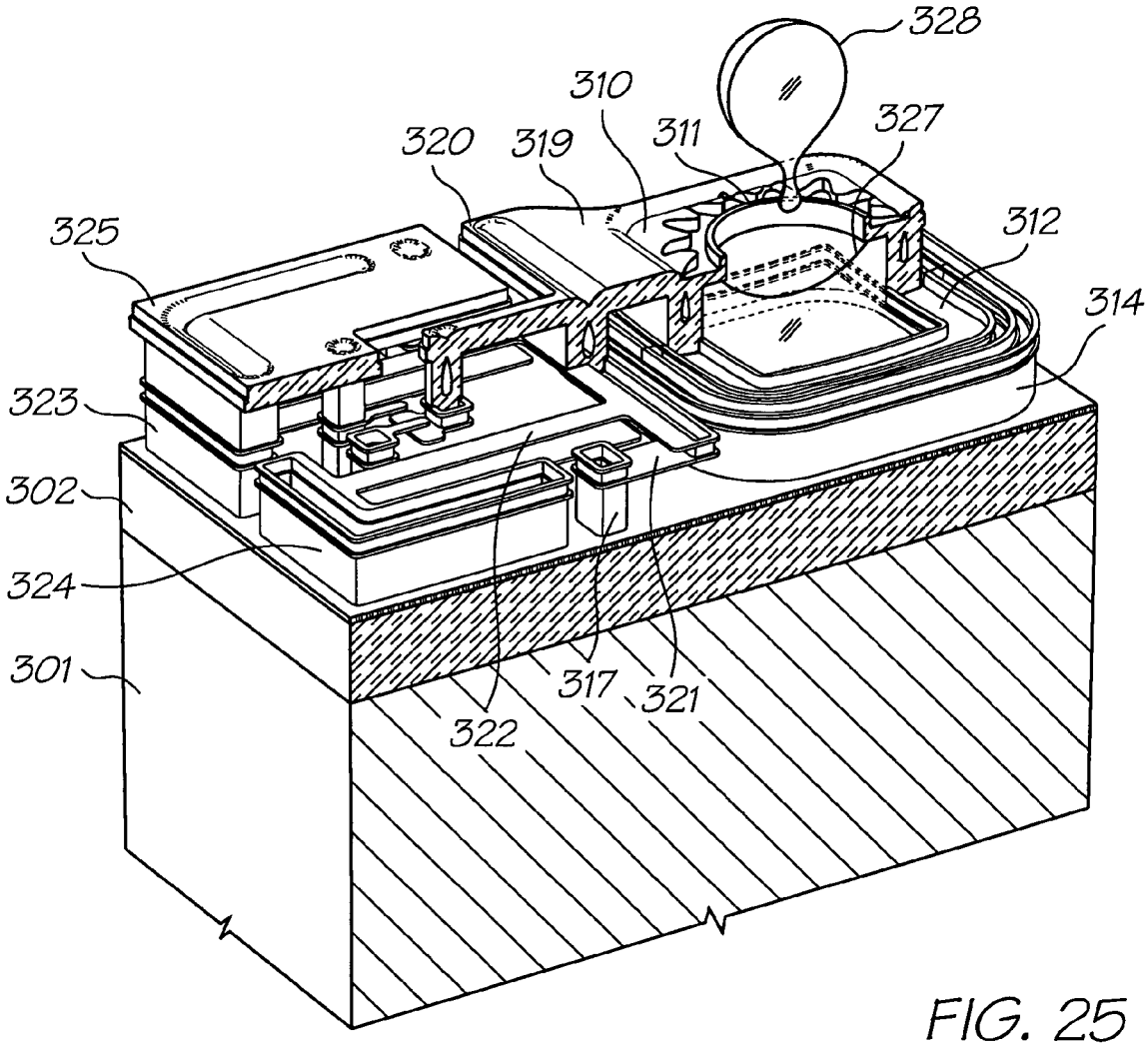
FIG. 25 shows in perspective a partial vertical sectional view of the nozzle at the later actuation state shown in FIG. 23.

As can best be seen from FIGS. 24 and 25, the actuator beam 322 is substantially U-shaped in plan, defining a current path between an electrode 323 and an opposite electrode 324. Each of the electrodes 323 and 324 is electrically connected to a respective point in the contact layer 303. The actuator beam 322 is also mechanically secured to an anchor 325, and the anchor 325 is configured to constrain motion of the actuator beam 322 to the left of FIGS. 21 to 23 when the nozzle arrangement 300 is activated.

The actuator beam 322 is conductive, being composed of TiN, but has a sufficiently high enough electrical resistance to generate self-heating when a current is passed between the electrodes 323 and 324. No current flows through the passive beams 321, so they do not experience thermal expansion.

In operation, the nozzle is filled with ink 326 that defines a meniscus 327 under the influence of surface tension. The ink 326 is retained in the chamber 308 by the meniscus 327, and will not generally leak out in the absence of some other physical influence.

To fire ink from the nozzle, a current is passed between the contacts 323 and 324, passing through the actuator beam 322. The self-heating of the beam 322 causes it to expand, with the actuator beam 322 being dimensioned and shaped so that it expands predominantly in a horizontal direction with respect to FIGS. 21 to 23. The expansion is constrained to the left by the anchor 325, so the end of the actuator beam 322 adjacent the lever arm 319 is impelled to the right.

The relative horizontal inflexibility of the passive beams 321 prevents them from allowing much horizontal movement of the lever arm 319. However, the relative displacement of the attachment points of the passive beams 321 and the actuator beam 322 respectively to the lever arm 319 causes a twisting movement that, in turn, causes the lever arm 319 to move generally downwardly with a pivoting or hinging motion. However, the absence of a true pivot point means that rotation is about a pivot region defined by bending of the passive beams 321.

Figure 22:
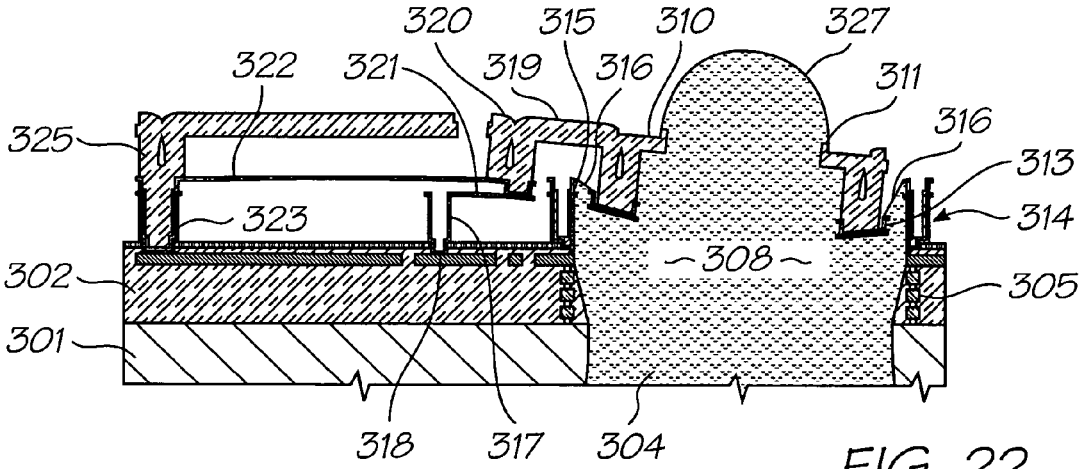
FIG. 22 shows a vertical sectional view of the nozzle of FIG. 21 at an initial actuation state.

The downward movement (and slight rotation) of the lever arm 319 is amplified by the distance of the nozzle wall 309 from the passive beams 321. The downward movement of the nozzle walls 309 and roof 310 causes a pressure increase within the chamber 308, causing the meniscus 327 to bulge as shown in FIG. 22. The surface tension of the ink causes the fluid seal 316 to be stretched by this motion, however ink is not allowed to leak out.

As shown in FIG. 23, at the appropriate time the drive current is stopped and the actuator beam 322 quickly cools and contracts. This contraction causes the lever arm 319 to commence its return to the quiescent position, which in turn causes a reduction in pressure in the chamber 308. The interplay of the momentum of the bulging ink and its inherent surface tension, and the negative pressure caused by the upward movement of the nozzle chamber 308 causes thinning, and ultimately snapping, of the bulging meniscus 327 to define an ink drop 328 that continues upwards until it contacts passing print media.

Immediately after the drop 328 detaches, the meniscus 327 forms the concave shape shown in FIG. 23. Surface tension causes the pressure in the chamber 308 to remain relatively low until ink has been suctioned upwards through the inlet or ink channel 304, which returns the nozzle arrangement and the ink to the quiescent state shown in FIG. 21.

Figure 26:
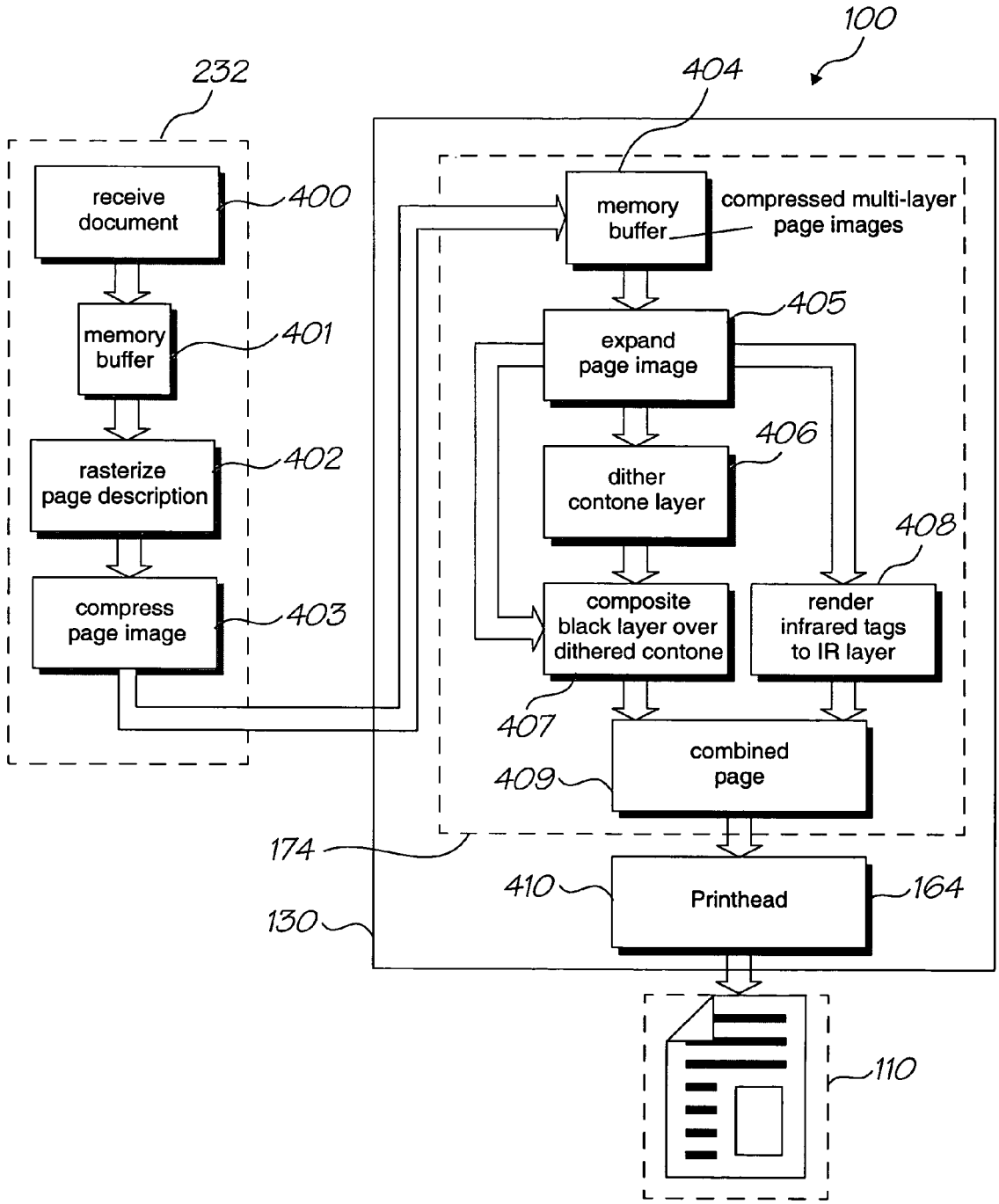
FIG. 26 shows a schematic diagram of document data flow in the printer of FIG. 1.

In order to control the delivery of the drops from each of the nozzles, the print engine assembly 130 uses the drive electronics 174. As described earlier, the drive electronics 174 receives image data of print jobs to be printed by the printer 100. Referring to FIG. 26, this image data may be received from an external data source, such as a computer system or the user's PC 232. The PC 232 is programmed to perform various steps involved in printing image data (i.e., a document), including receiving the document (step 400), buffering and rasterising the document to provide a page description (steps 401 and 402) and compressing this to provide a page image (step 403) suitable for transmission to the print engine assembly 130 of the printer 100.

At the drive electronics 174 of the print engine assembly 130 provided in the printer 100, the compressed, multi-layered page image is buffered (step 404) and then expanded to separate the different layers of the page image (step 405). The expanded contone layer is dithered (step 406) and then the black layer is composited over the dithered contone layer (step 407). Coded data can also be rendered (step 408) to form an additional layer, to be printed using infrared ink, for example, that is substantially invisible to the human eye. The black, dithered contone and infrared layers are combined (step 409) to form a page that is supplied to the printhead 164 for printing (step 410), which as mentioned above, is preferably configured to print in five colours.

Further, the document data is preferably divided into a high-resolution bi-level mask layer for text and line art and a medium-resolution contone colour image layer for images or background colours. Optionally, coloured text can be supported by the addition of a medium-to-high-resolution contone texture layer for texturing text and line art with colour data taken from an image or from flat colours. The contone layers are generalised by representing them in abstract "image" and "texture" layers which can refer to either image data or flat colour data. This division of data into layers based on content follows the base mode Mixed Raster Content (MRC) model known to those skilled in the art. Like the MRC base mode, compromises are made in some cases when data to be printed overlap. For example, all overlaps may be reduced to a 3-layer representation in a process (collision resolution) embodying the compromises explicitly.

Figure 27:
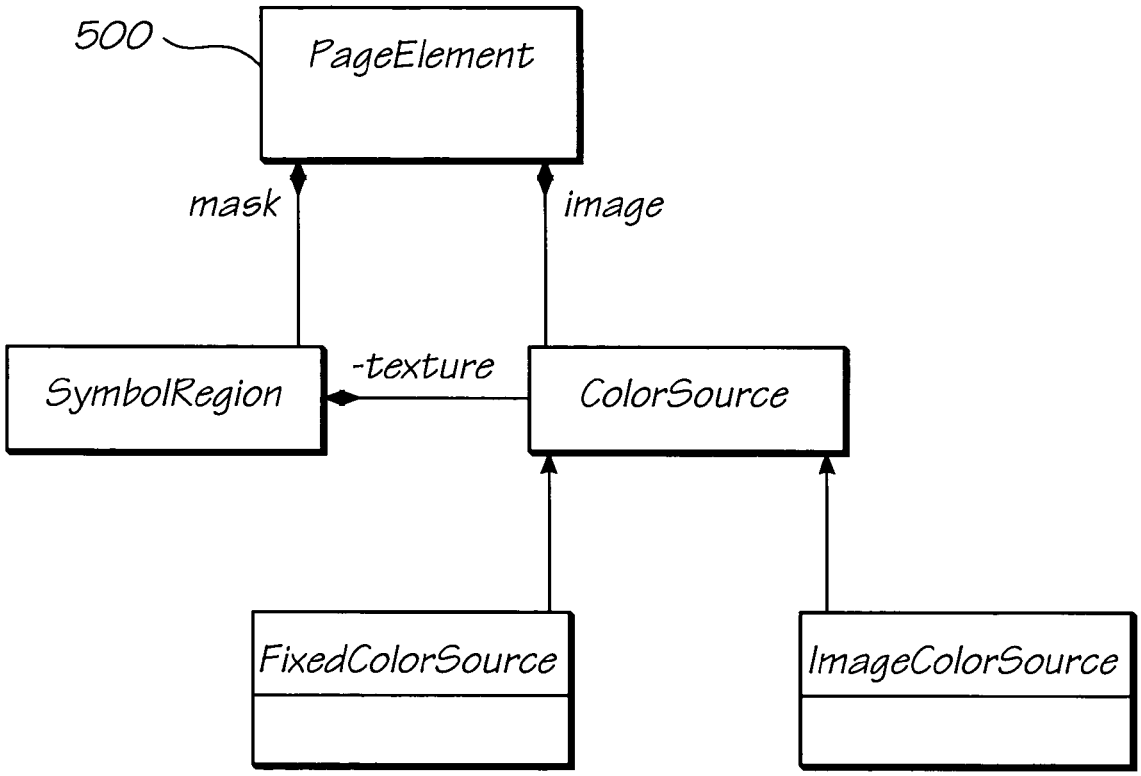
FIG. 27 illustrates a data representation of a page element used in FIG. 26.

The central data structure is a generalised representation of the three layers, called a page element 500, shown in a simplified UML diagram in FIG. 27. The page element 500 can be used to represent units ranging from single rendered elements emerging from a rendering engine up to an entire band of a print job. Conceptually, the bi-level symbol region selects between the two colour sources, as described in more detail below with reference to FIGS. 27 and 28. It will be appreciated that the device components shown in FIG. 28, which carry out the steps 400 to 410 shown in FIG. 26, will typically be device dependent, in that they process the data into a form required by a software or hardware component further downstream.

Figure 28:
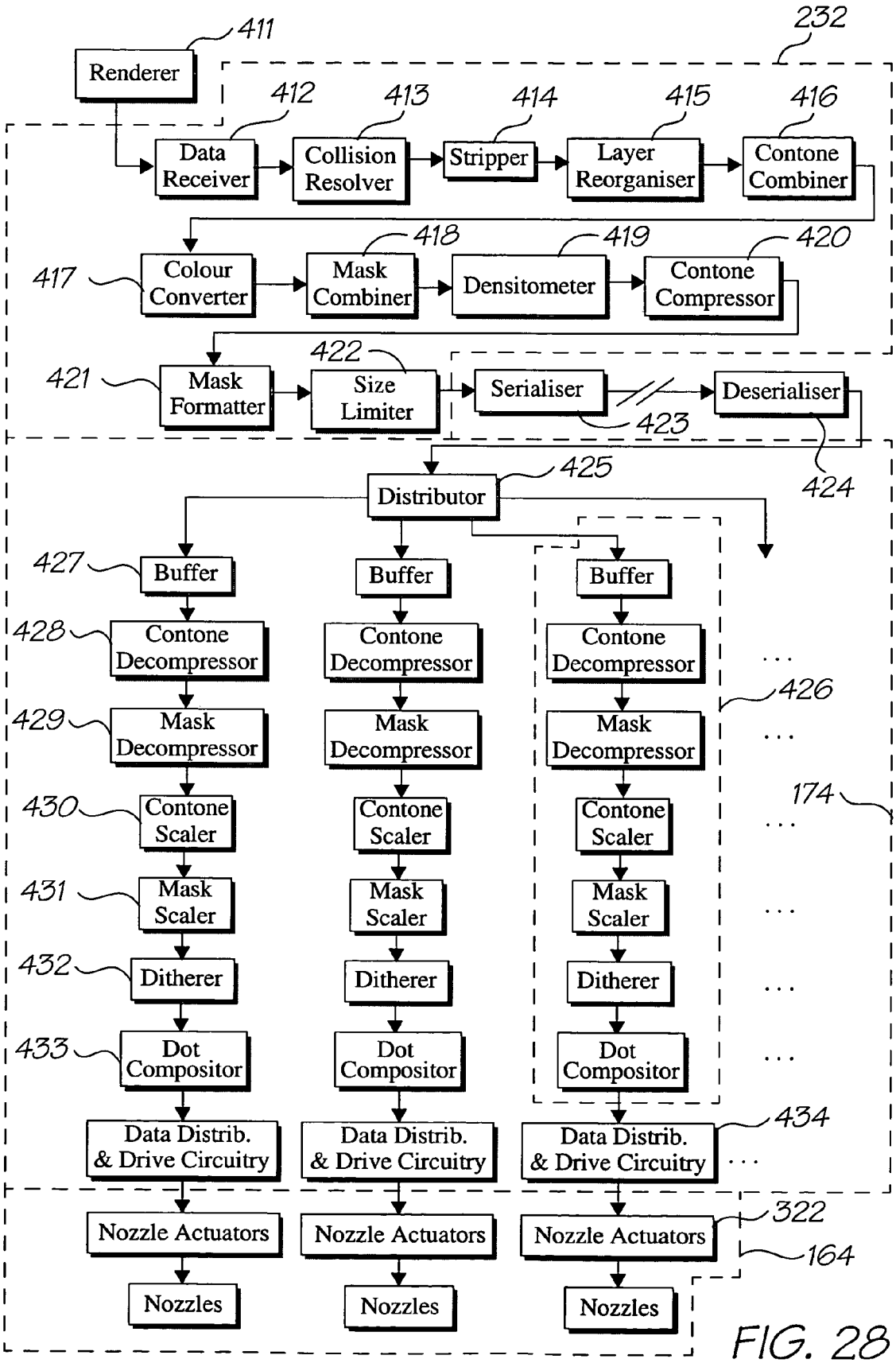
FIG. 28 shows a more detailed schematic diagram showing an architecture used in FIG. 26.

In FIG. 28, a renderer 411 is provided outside of the more general printer system pipeline shown in FIG. 26 in order to render files to be printed and deliver the rendered elements to a data receiver 412 (step 400) of the pipeline, using an Application Programming Interface (API) exposed by the data receiver 412 for that purpose. The rendered elements are delivered in order according to the painter's algorithm, which is well known to those skilled in the art. The data passed in through the API is converted by the data receiver 412 into lists of dictionaries and page elements for processing in later stages.

The data is then rasterised (step 402 in FIG. 26) as follows. A collision resolver 413 accepts the simple page elements created by the data receiver 412 (via buffering at step 401) and creates a fully opaque "resolved" page element for each intersection of a new element with the background and any elements already present. Fundamentally, the collision resolver 413 guarantees that the entire page is tiled with opaque elements. A stripper 414 divides a band of data into horizontally overlapping pieces, which is performed since the printer 100 is relatively fast and as such uses multiple parallel devices in order to achieve the required output dot-rate. In such cases, each horizontally overlapping piece is fed into a corresponding device downstream. Where such data division is not required, the stripper 414 can be omitted.

Different printing configurations will require different configurations of layers for delivery to the downstream hardware. A layer reorganiser 415 converts 3-layer page elements to the appropriate 2- or 3-layer form for the specific configuration. Again, there may be cases in which this function is not required, in which case the layer organiser 415 can be omitted. A contone combiner 416 combines and clips the image and texture layers of all page elements in a strip into single image and texture layers, as required by downstream hardware.

A colour converter 417 transforms the contone planes of all page elements from the input colour space to a device-specific colour space (which is usually CMYK). A mask combiner 418 performs the same operation on the mask layer as the contone combiner 416 performs on the contone layers. All elements are clipped to a strip boundary and drawn into a single mask buffer.

A densitometer 419 measures the density of the current page as a percentage of total possible density. This operation is necessary when the power supply of the printer 100 is not able to handle a fully dense page at full speed. A contone compressor 420 compresses the contone layers of all page elements in order to reduce downstream memory and/or transmission bandwidth requirements. A mask formatter 421 converts the mask layer of page elements, which may be represented as regions of placed symbol references, into the form expected by a downstream mask decompressor.

A size limiter 422 ensures that all size limitations, for bands and for entire pages, are adhered to, by either dividing bands into smaller bands or by recompressing the data, repeating until the constraint is satisfied. If data is to be transmitted to the printer 100 between pipeline stages, a serialised form of the data structures is generated (in a serialiser 423), transmitted, then deserialised (in a deserialiser 424).

Within the drive electronics 174 of the print engine assembly 130 incorporated in the printer 100, a distributor 425 converts data from a proprietary representation into a hardware-specific representation and ensures that the data for each strip is sent to the correct hardware device whilst observing any constraints or requirements on data transmission to these devices. The distributor 425 distributes the converted data to an appropriate one of a plurality of pipelines 426. The pipelines 426 are identical to each other, and in essence provide decompression, scaling and dot compositing functions to generate a set of printable dot outputs for the nozzles of the printhead 164.

Each pipeline 426 includes a buffer 427 for receiving the page image data from the PC 232 (step 404 in FIG. 26). A contone decompressor 428 decompresses the colour contone planes and a mask decompressor 429 decompresses the monotone (text) layer (step 405 in FIG. 26). Further, a contone scaler 430 and a mask scaler 431 are provided to scale the decompressed contone and mask planes, respectively, to take into account the size of the print media onto which the processed page is to be printed by the printhead 164.

The scaled contone planes are then dithered by a ditherer 432 using stochastic dispersed-dot dither (step 406 in FIG. 26). Clustered-dot, or amplitude-modulated, dither is not used since dispersed-dot, or frequency-modulated, dither reproduces high spatial frequencies (i.e., image detail) almost to the limits of the dot resolution while simultaneously reproducing lower spatial frequencies to their full colour depth when spatially integrated by the eye. A stochastic dither matrix is carefully designed to be relatively free of objectionable low-frequency patterns when tiled across the image. As such, its size typically exceeds the minimum size required to support a particular number of intensity levels (e.g., 16×16×8 bits for 257 intensity levels).

The dithered planes are then composited in a dot compositor 433 on a dot-by-dot basis to provide dot data suitable for printing (steps 407 and 409 in FIG. 26). This data is forwarded to data distribution and drive circuitry 434, which in turn distributes the data to the correct nozzle actuators 322 of the printhead 164 which in turn cause ink to be ejected from the correct nozzles at the correct time (step 410 in FIG. 26).

In the above system, a mainly software-based PC portion 232 is provided prior to the serialiser 423, and a mainly hardware-based print engine assembly portion 130, that is located within the printer 100 remote from the PC 232, is provided including everything from the deserialiser 424 onwards. It will be appreciated, however, that the indicated division between computer system and printer is somewhat arbitrary, and various components can be placed on different sides of the divide without substantially altering the operation as a whole. It will also be appreciated that some of the device components can be handled in hardware or software remotely from the computer system and printer. For example, rather than relying on the general-purpose processor of the PC, some of the components in the architecture can be accelerated using dedicated hardware.

Preferably, the hardware pipelines 426 are embodied in a controller of the print engine assembly 130, which also preferably includes one or more system on a chip (SoC) components, as well as the print engine assembly pipeline control application specific logic, configured to perform some or all of the functions described above in relation to the printing pipeline.

Figure 29:
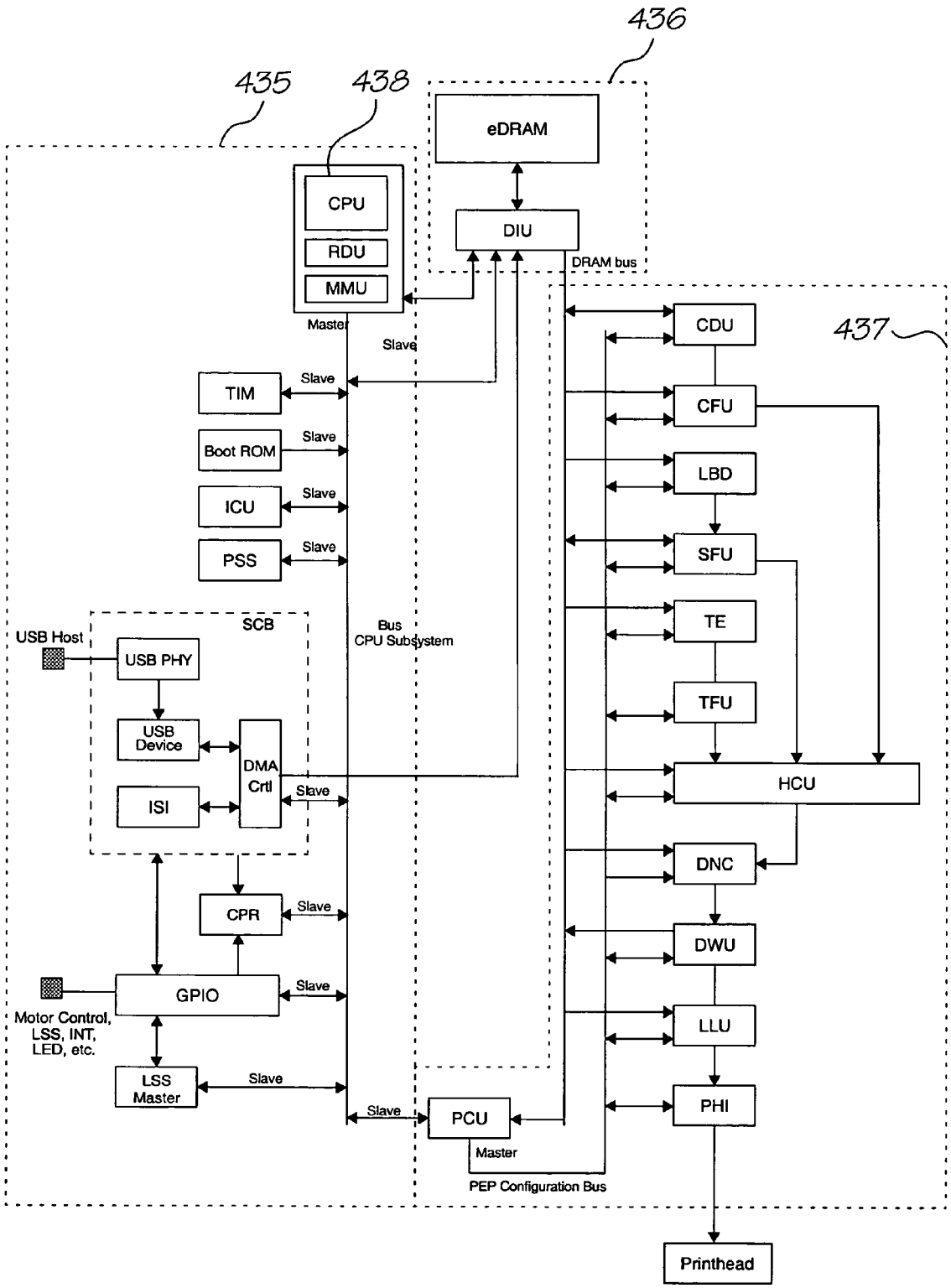
FIG. 29 shows a schematic view of a controller incorporated in a print engine assembly of the printer of FIG. 1.

Referring to FIG. 29, from the highest point of view the controller of the print engine assembly 130 consists of three distinct subsystems: a central processing unit (CPU) subsystem 435, a dynamic random access memory (DRAM) subsystem 436 and a print engine assembly pipeline (PEP) subsystem 437. Various components of these subsystems 435 to 437 are described below, with a more detailed description of these components, including their various functions, being provided later in Tables 1 to 3.

The CPU subsystem 435 includes a CPU 438 that controls and configures all aspects of the other subsystems and provides general support for interfacing and synchronizing the various components of the printer 100 with the print engine assembly 130. It also controls the low-speed communication to Quality Assurance (QA) devices (described in more detail later). The CPU subsystem 435 also contains various peripherals to aid the CPU 438, such as General Purpose Input Output ("GPIO"), which includes motor control, etc, Interrupt Controller Unit ("ICU"), Low-Speed Serial ("LSS") master and general Timers ("TIM").

The DRAM subsystem 436 accepts requests from the CPU 438, Serial Communications Block ("SCB") on the CPU subsystem 435, which provides a full speed USB 1.1 interface to the host as well as an Interface ("INT") to other controllers of the print engine assembly 130 and blocks within the PEP subsystem 437. The DRAM subsystem 436, and in particular DRAM Interface Unit ("DIU") thereof, arbitrates the various requests and determines which request should win access to DRAM incorporated therein. DIU arbitrates based on configured parameters, to allow sufficient access to DRAM for all requestors. DIU also hides the implementation specifics of DRAM, such as page size, number of banks and refresh rates.

The PEP subsystem 437 accepts compressed pages from DRAM and renders them to bi-level dots for a given print line destined for PrintHead Interface ("PHI") that communicates directly with the printhead ICs of the printhead 164. The first stage of the page expansion pipeline includes Contone Decoder Unit ("CDU"), Lossless Bi-level Decoder ("LBD") and Tag Encoder ("TE"). CDU expands the JPEG-compressed contone (typically CMYK) layers, LBD expands the compressed bi-level layer (typically K), and TE encodes infrared tags for later rendering (typically in IR or K ink). The output from the first stage is a set of buffers: Contone FIFO Unit ("CFU"); Spot FIFO Unit ("SFU"); and Tag FIFO Unit ("TFU"). CFU and SFU buffers are implemented in dynamic random access memory.

The second stage includes Halftone Compositor Unit ("HCU"), which dithers the contone layer and composites position tags and the bi-level spot layer over the resulting bi-level dithered layer. A number of compositing options can be implemented, depending upon the printhead 164 with which the controller is used. Up to six channels of bi-level data are produced from this stage, although not all channels may be present on the printhead 164. For example, the printhead 164 may be CMY only, with K pushed into the CMY channels and IR ignored. Alternatively, the encoded tags may be printed in K if IR ink is not available (or for testing purposes).

In the third stage, Dead Nozzle Compensator ("DNC") compensates for dead nozzles in the printhead 164 by colour redundancy and error diffusing of dead nozzle data into surrounding dots. The resultant bi-level six channel dot-data (typically CMYK, IR and fixative) is buffered and written to a set of line buffers stored in DRAM via Dotline Writer Unit (DWU). Finally, the dot-data is loaded back from DRAM, and passed to PHI via a dot FIFO (not shown). The dot FIFO accepts data from Line Loader Unit ("LLU") at the system clock rate, while PHI removes data from the dot FIFO and sends it to the printhead 164 at a rate of ⅔ times the system clock rate.

The details and functions of the above-described components of the subsystems 435 to 437 and those shown in FIG. 29 but not described above are provided in Tables 1 to 3 below, for the CPU subsystem 435, the DRAM subsystem 436 and the PEP subsystem 437, respectively.

TABLE 1

| Acronym | Component | Description |
|---|---|---|
| DIU | DRAM Interface Unit | Provides an interface for DRAM read and write access for the various controllers, the CPU 251 and SCB block, arbitration between competing units and controls access to DRAM |
| DRAM | (embedded) DRAM | 20 Mbits of embedded DRAM |

TABLE 2

| Acronym | Component | Description |
|---|---|---|
| CPU | Central Processing Unit | For system configuration and control |
| MMU | Memory Management Unit | Limits access to certain memory address areas in CPU user mode |
| RDU | Real-time Debug Unit | Facilitates the observation of the contents of most of the CPU addressable registers in the controller, in addition to some pseudo-registers in real time |
| TIM | (general) Timer | Contains watchdog and general system timers |
| LSS | Low-Speed Serial interfaces | Low level controller for interfacing with the QA devices |
| GPIO | General Purpose Input/Outputs | General IO controller with built-in motor control and LED pulse units and de-glitch circuitry |
| ROM | Boot ROM | 16 KBytes of System Boot ROM code |
| ICU | Interrupt Controller Unit | General Purpose interrupt controller with configurable priority, and masking |
| CPR | Clock, Power and Reset block | Central Unit for controlling and generating the system clocks and resets and power-down mechanisms |

TABLE 2-continued

| Acronym | Component | Description |
|---|---|---|
| PSS | Power Save Storage | Storage retained while system is powered down |
| USB | Universal Serial Bus device | USB device controller for interfacing with the host USB |
| INT | Interface | Interface controller for data and control communication with other controllers in a multiple controller print engine assembly 130 |
| SCB | Serial Communication Block | Contains both USB and Interface blocks |

TABLE 3

| Acronym | Component | Description |
|---|---|---|
| PCU | PEP controller | Provides the CPU 251 with the means to read and write PEP Unit registers, and read and write DRAM in single 32-bit chunks |
| CDU | Contone Decoder Unit | Expands JPEG compressed contone layer and writes decompressed contone to DRAM |
| CFU | Contone FIFO Unit | Provides line buffering between CDU and HCU |
| LBD | Lossless Bi-level Decoder | Expands compressed bi-level layer |
| SFU | Spot FIFO Unit | Provides line buffering between LBD and HCU |
| TE | Tag Encoder | Encodes tag data into line of tag dots |
| TFU | Tag FIFO Unit | Provides tag data storage between TE and HCU |
| HCU | Halftoner Compositor Unit | Dithers contone layer and composites the bi-level spot and position tag dots |
| DNC | Dead Nozzle Compensator | Compensates for dead nozzles by colour redundancy and error diffusing dead nozzle data into surrounding dots |
| DWU | Dotline Writer Unit | Writes out the six channels of dot data for a given print-line to a line store DRAM |
| LLU | Line Loader Unit | Reads the expanded page image from the line store, formatting the data appropriately for the printhead 164 |
| PHI | PrintHead Interface | Responsible for sending dot data to the nozzles of the printhead 164 and for providing line synchronization between multiple controllers, and provides a test interface to the printhead 164 such as temperature monitoring and dead nozzle identification |

Preferably, DRAM of the DRAM subsystem 436 is 2.5 Mbytes in size, of which about 2 Mbytes are available for compressed page store data. A compressed page is received in two or more bands, with a number of bands stored in memory. As a band of the page is consumed by the PEP subsystem 437 for printing, a new band can be downloaded. The new band may be for the current page or the next page. Using banding it is possible to begin printing a page before the complete compressed page is downloaded, but care must be taken to ensure that data is always available for printing or a buffer under-run may occur.

The embedded USB 1.1 device accepts compressed page data and control commands from the PC 232 (FIG. 26), and facilitates the data transfer to either DRAM, or to another controller in a multiple controller print engine assembly. A multiple controller print engine assembly 130 may be used to perform different functions depending upon the particular implementation. For example, in some cases a controller can be used simply for its onboard DRAM, while another controller attends to the various decompression and formatting functions described above. This can reduce the chance of buffer under-run, which can happen in the event that the printhead 164 commences printing a page prior to all the data for that page being received and the rest of the data is not received in time. Adding an extra controller for its memory buffering capabilities doubles the amount of data that can be buffered, even if none of the other capabilities of the additional controller are utilized.

Each controller may have several QA devices designed to cooperate with each other to ensure the quality of the mechanics of the printer 100, the quality of the ink supply so the nozzles of the printhead 164 will not be damaged during printing and the quality of the software to ensure the printhead 164 and the mechanics of the printer 100 are not damaged.

Normally, each controller of the print engine assembly 130 will have an associated QA device (not shown) which stores information on the attributes of the printer 100, such as the maximum printing speed. The cartridge unit 162 of the print engine assembly 130 also contains an ink QA device (not shown) which stores information on the cartridge unit 162, such as the amount of ink remaining in the ink storage and handling reservoirs 166. The printhead 164 also has a QA device (not shown) which is configured to act as a ROM (effectively as an EEPROM) that stores printhead-specific information such as dead nozzle mapping and the characteristics of the printhead 164. The CPU 438 in the CPU subsystem 435 of the controller also runs a logical (software) QA device (not shown) and may optionally load and run program code from a QA device that effectively acts as a serial EEPROM. Generally, all of the QA devices are physically identical, with only the contents of flash memory differentiating one from the other.

Each controller has two LSS system buses that can communicate with QA devices for system authentication and ink usage accounting. A large number of QA devices can be used per bus and their position in the system is unrestricted with the exception that printhead QA and ink QA devices should be on separate LSS busses.

In use, the logical QA device communicates with the ink QA device to determine remaining ink. The reply from the ink QA device is authenticated with reference to the printhead QA device. The verification from the printhead QA device is itself authenticated by the logical QA device, thereby indirectly adding an additional authentication level to the reply from the ink QA device.

Data passed between the QA devices, other than the printhead QA device, is authenticated by way of digital signatures. For example, HMAC-SHAI authentication may be used for data, and RSA may be used for program code, although other schemes could be used instead.

A single controller can control a plurality of the printhead ICs of the printhead 164 and up to the six printing fluid channels (e.g., CMYK, IR and F). However, the controller is preferably colour space agnostic. Such that, although the controller can accept contone data as CMYX or RGBX, where X is an optional 4th channel, it also can accept contone data in any print colour space. Additionally, the controller provides a mechanism for arbitrary mapping of input channels to output channels, including combining dots for ink optimization and generation of channels based on any number of other channels. However, inputs are typically CMYK for contone input, K for the bi-level input, the optional IR tag dots are typically rendered to an infrared layer, and a fixative channel is generated due to the high-speed printing capability.

Further, the controller is also preferably resolution agnostic, such that it merely provides a mapping between input resolutions and output resolutions by means of scale factors and has no knowledge of the physical resolution of the printhead 164. Further still, the controller is preferably pagelength agnostic, such that successive pages are typically split into bands and downloaded into the page store as each band of information is consumed.

Figure 30:
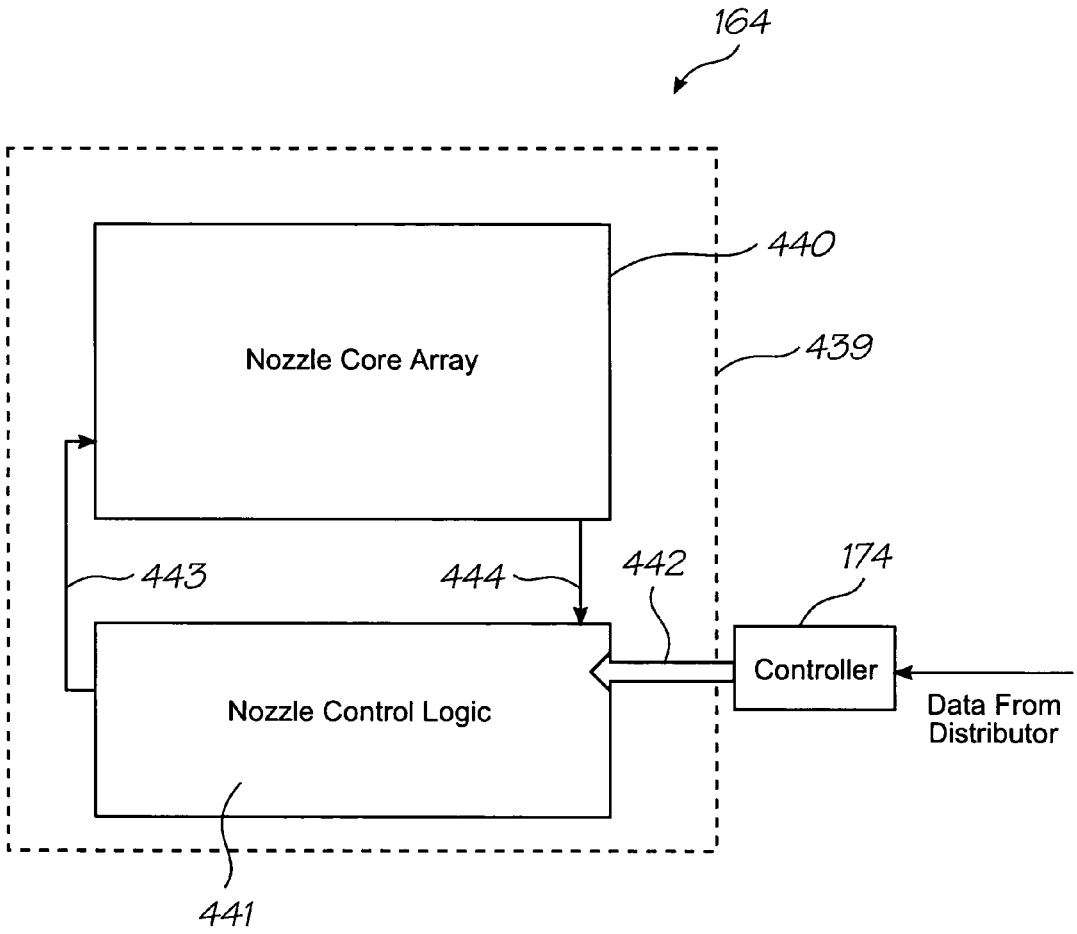
FIG. 30 shows a schematic diagram illustrating CMOS drive and control blocks for use in FIG. 26.

Turning now to FIGS. 30 to 33, the printhead ICs of the printhead 164 will be further described. For clarity, only one printhead IC 439 is shown in FIG. 30, but it will be appreciated that a corresponding arrangement is implemented for the other printhead ICs.

FIG. 30 illustrates an overview of the printhead IC 439 and its connections to the controller of the drive electronics 174 of the print engine assembly 130. The printhead IC 439 includes a nozzle core array 440 containing the repeated logic for firing each of the nozzles provided in the printhead IC 439 and nozzle control logic 441 for generating the timing signals to fire the nozzles in accordance with data received from the controller via a high-speed link 442. The nozzle control logic 441 is configured to send serial data to the nozzle core array 440 for printing via a link 443. Status and other operational information about the nozzle core array 440 is communicated back to the nozzle control logic 441 via another link 444.

Figure 31:
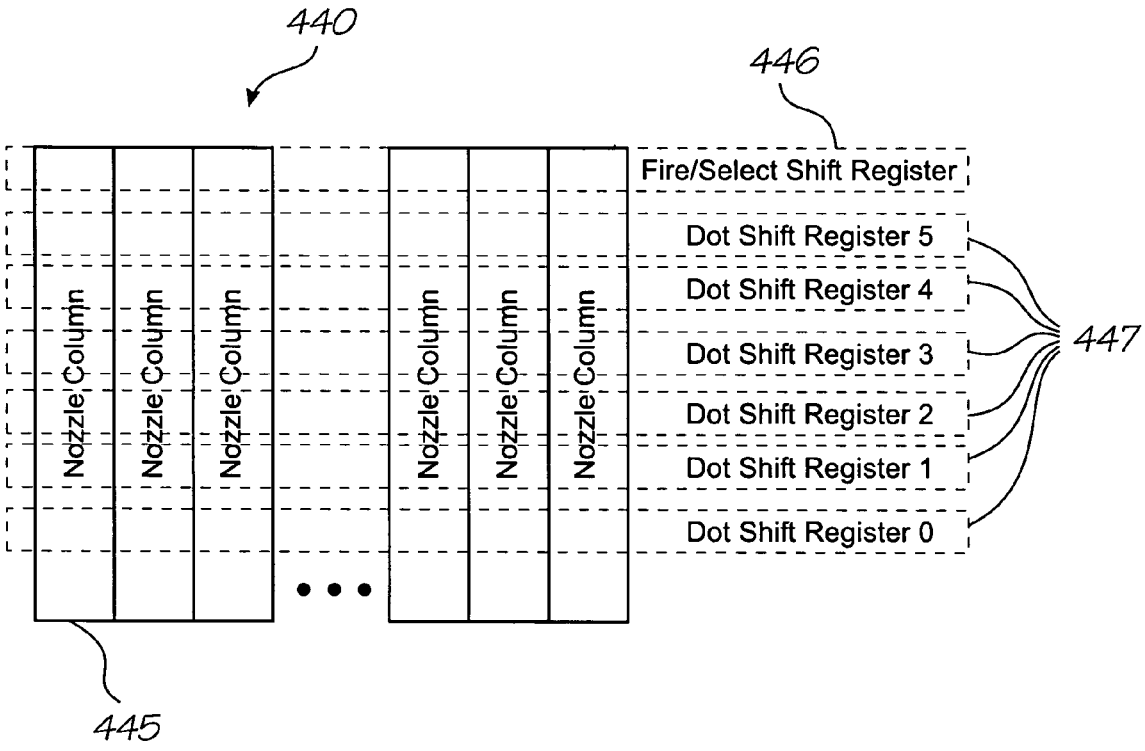
FIG. 31 shows a schematic diagram illustrating the relationship between nozzle columns and dot shift registers in the CMOS blocks of FIG. 30.
Figure 32:
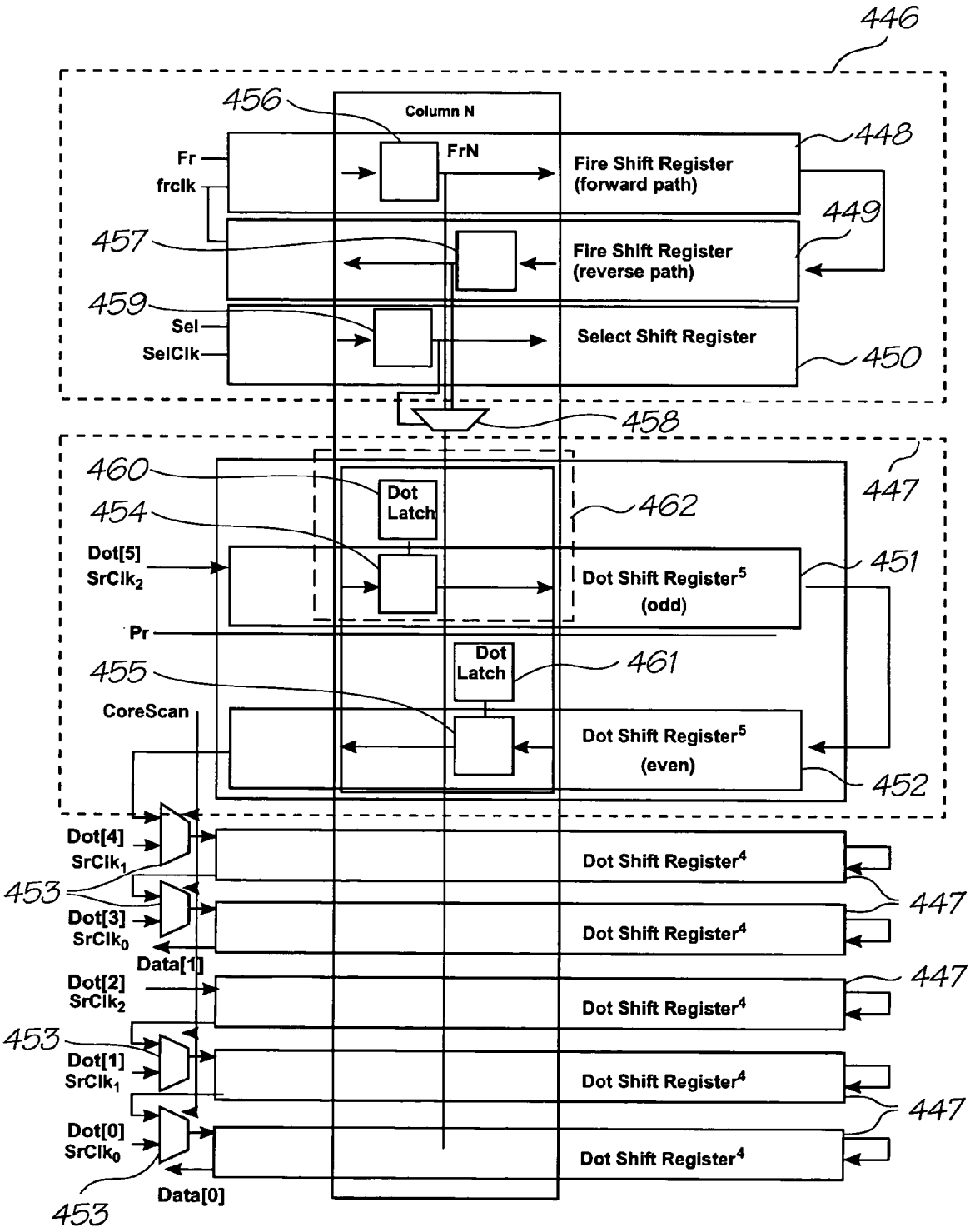
FIG. 32 shows a more detailed schematic diagram illustrating a unit cell and its relationship to the nozzle columns and dot shift registers of FIG. 31.

The nozzle core array 440 is shown in detail in FIGS. 31 and 32. As can be seen in FIG. 31 the nozzle core array 440 comprises an array of nozzle columns 445, a fire/select shift register 446 and up to six channels, each of which is represented by a corresponding dot shift register 447.

As shown in FIG. 32, the fire/select shift register 446 includes a forward path fire shift register 448, a reverse path fire shift register 449 and a select shift register 450, and each dot shift register 447 includes an odd dot shift register 451 and an even dot shift register 452. The odd and even dot shift registers 451 and 452 are connected at one end such that data is clocked through the odd shift register 451 in one direction, then through the even shift register 452 in the reverse direction. The output of all but the final even dot shift register 452 is fed to one input of one of plurality of multiplexers 453. This input of the multiplexers 453 is selected by a signal (CoreScan) during post-production testing. In normal operation, the CoreScan signal selects dot data input Dot[x] supplied to the other input of each of the multiplexers 453. This causes Dot [x] for each colour to be supplied to the respective dot shift registers 447.

A single column N of the array of nozzle columns 445 is also shown in FIG. 32. In the embodiment shown, the column N includes 12 data values, comprising an odd data value 454 and an even data value 455 for each of the six dot shift registers 447. Column N also includes an odd fire value 456 from the forward fire shift register 448 and an even fire value 457 from the reverse fire shift register 449, which are supplied as inputs to a multiplexer 458. The output of the multiplexer 458 is controlled by a select value 459 in the select shift register 450. When the select value 459 is zero, the odd fire value 456 is output, and when the select value 459 is one, the even fire value 457 is output.

Each of the odd and even data values 454 and 455 is provided as an input to corresponding odd and even dot latches 460 and 461, respectively. Each of the dot latches 460 and 461 and its associated data value 454 and 455 form a unit cell, such as a unit cell 462 shown in FIG. 32 for the odd latch 460 and the odd data value 454. This situation for the odd dot shift register 451 is illustrated in more detail in FIG. 33, which is also applicable to the situation for the even dot shift register 452.

Figure 33:
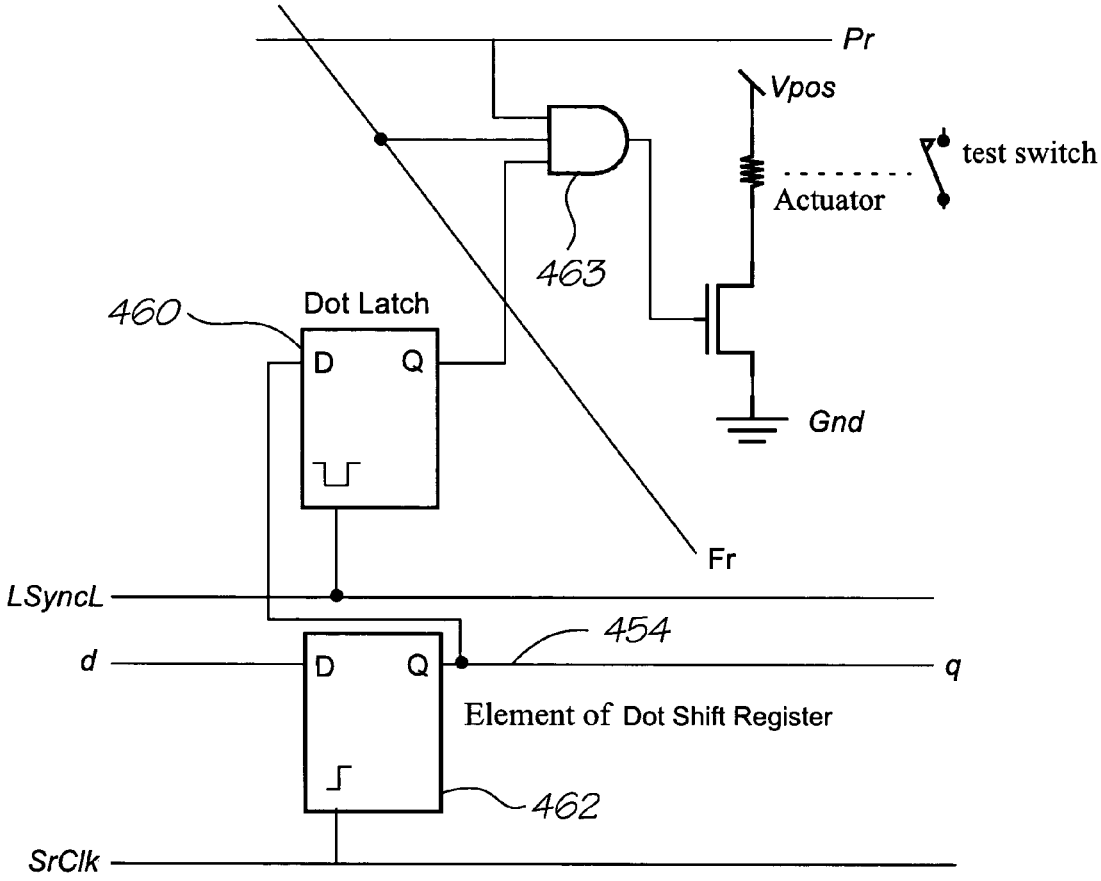
FIG. 33 shows a circuit diagram illustrating logic for a single nozzle in FIG. 26.

Referring to FIG. 33, the odd dot latch 460 is a D-type flip-flop that accepts the output of the odd data value 454, which is held by the unit cell (a D-type flip-flop) 462 which forms an element of the odd dot shift register 451. The data input to the flip-flop 462 is provided from the output of a previous element in the odd dot shift register 451 (unless the element under consideration is the first element in the shift register 447, in which case its input is the Dot[x] value). Data is clocked from the output of the flip-flop 462 into the odd dot latch 460 upon receipt of a negative pulse provided on line LsyncL.

The output of the odd dot latch 460 is provided as one of the inputs to a three-input AND gate 463. Other inputs to the AND gate 463 are a fire enable (Fr) signal (from the output of multiplexer 458) and a pulse profile (Pr) signal. The firing time of a nozzle is controlled by the pulse profile signal Pr and can be, for example, lengthened to take into account a low voltage condition that arises due to low battery, in a situation where the power supply of the printer 100 is provided as a battery element (not shown) mounted in the body 102, for example. This is to ensure that a relatively consistent amount of ink is efficiently ejected from each nozzle as it is fired. The profile signal Pr may be the same for each of the dot shift registers 260, which provides a balance between complexity, cost and performance. However, the Pr signal can be applied globally (i.e., is the same for all nozzles) or can be individually tailored to each unit cell or even to each nozzle.

Once the data is loaded into the odd dot latch 460, the Fr and Pr signals are applied to the AND gate 463, combining to trigger the nozzle to eject a dot of ink for each odd dot latch 460 that contains a logic 1.

The signals for each nozzle channel as shown in FIGS. 32 and 33 are summarized in Table 4 below.

TABLE 4

| Name | Direction | Description |
|---|---|---|
| D | Input | Input dot pattern to shift register bit |
| Q | Output | Output dot pattern from shift register bit |
| SrClk | Input | Shift register clock in; d is captured on rising edge of this clock |
| Fr | Input | Fire enable; needs to be asserted for nozzle to fire |
| Pr | Input | Profile; needs to be asserted for nozzle to fire |

As shown in FIG. 33, the Fr signals are routed on a diagonal to enable firing of one colour in the current column, the next colour in the following column, and so on. This averages the current demand by spreading it over six columns in time-delayed fashion.

The dot latches and the latches forming the various shift registers are fully static and are CMOS-based. The design and construction of latches is well known to those skilled in the art and so is not described in detail herein.

As stated earlier, the printhead 164, which has a printing surface or zone across the width of a maximum-sized page of print media that can be printed on using the printer 100, may incorporate at least 5,000 nozzles and even more than 50,000 nozzles in order to provide the required quality of printing at the high-speed printing of the printer 100 across this page-width. For example, the combined printhead ICs 252 may define a printhead having 13824 nozzles per channel, including the coloured ink and fixative channels.

The nozzle speed may be as much as 20 kHz for the printer 100 capable of printing at about 60 ppm, and even more for higher speeds. At this range of nozzle speeds the amount of ink than can be ejected by the entire printhead 164 is at least 50 million drop per second. However, as the number of nozzles is increased to provide for higher-speed and higher-quality printing at least 100 million drops per second, preferably at least 300 million drops per second, and more preferably at least 1 billion drops per second may be delivered.

Consequently, in order to accommodate printing at these speeds, the drive electronics 174, and particularly the controller(s) thereof, must calculate whether a nozzle is to eject a drop of ink at a rate of at least 50 million dots per second, and depending on the printing speed, at least 100 million dots per second, preferably at least 300 million dots per second, and more preferably at least 1 billion dots per second for the higher-speed, higher-quality printing applications.

For the colour printer 100 printing with the maximum width of A4 paper, the above-described ranges of the number of nozzles and print speeds results in an area print speed of at least 50 $cm^2$ per second, and depending on the printing speed, at least 100 $cm^2$ per second, preferably at least 200 $cm^2$ per second, and more preferably at least 500 $cm^2$ per second at the higher-speeds.

While the present invention has been illustrated and described with reference to exemplary embodiments thereof, various modifications will be apparent to and might readily be made by those skilled in the art without departing from the scope and spirit of the present invention. Accordingly, it is not intended that the scope of the claims appended hereto be limited to the description as set forth herein, but, rather, that the claims be broadly construed.

What is claimed is:

1. A wall mounted printer unit comprising:

a body mountable to a substantially vertical surface in a suspended arrangement;

a cradle unit removably mounted to the body;

a cartridge unit removably received within the cradle unit, the cartridge unit incorporating a pagewidth printhead for printing on print media; and a print media supply for supplying print media to the pagewidth printhead, the print media supply being mounted in the body so that the print media is angled relative to the vertical surface, wherein the cradle and cartridge units are mounted below the print media supply and above a media exit slot in the body so that the print media is printed on by the printhead as the print media moves vertically from the print media supply to the exit slot, and the cradle and cartridge units and print media supply are contained in the body so as to be substantially hidden.

2. A printer unit according to claim 1, wherein the cartridge unit further incorporates at least one ink storage reservoir from which the printhead draws ink for printing on said print media.

3. A printer unit according to claim 1, wherein the cradle unit incorporates drive electronics for controlling the printing performed by the printhead.

4. A printer unit according to claim 1, wherein the body has a rear surface arranged to be mountable to said substantially vertical surface and an inner section arranged to house the cradle unit.

5. A printer unit according to claim 4, wherein the rear surface of the body is arranged with mounting bosses for mounting the printer unit to said substantially vertical surface.

6. A printer unit according to claim 4, wherein the rear surface of the body is arranged with a hook for mounting the printer unit over a top surface of said substantially vertical surface.

7. A printer unit according to claim 4, wherein said substantially vertical surface is a wall.

8. A printer unit according to claim 4, wherein said substantially vertical surface is a privacy screen of an office workstation.

9. A printer unit according to claim 4, wherein:

the inner section of the body is further arranged to mount the print media supply; and the rear surface of the body is further arranged to mount an extendable print media collector for collecting print media printed on by the pagewidth printhead.

10. A printer unit according to claim 1, wherein the body has a front surface which is adapted to receive an ornamentation.

11. A printer unit according to claim 1, wherein the body is arranged to house a print media collector which is automatically extendable from the body upon commencement of printing to collect the printed media exiting the exit slot.

12. A printer unit according to claim 1, wherein the pagewidth printhead is arranged as a two-dimensional array of at least 20000 printing nozzles for printing across the width of said print media.

13. A printer unit according to claim 1, wherein the pagewidth printhead incorporates an array of ink ejecting nozzles arranged to print on said print media by ejecting drops of ink across the width of said print media at a rate of at least 50 million drops per second.

14. A printer unit according to claim 1, wherein the print media supply is mounted in the body so that the print media is angled by at least 5 degrees relative to the vertical surface.

15. A printer unit according to claim 12, wherein the print media supply is mounted in the body so that the print media is angled by at least 10 degrees relative to the vertical surface.

* * * * *